US008535080B2

(12) United States Patent
Nakatsuji et al.

(10) Patent No.: US 8,535,080 B2
(45) Date of Patent: Sep. 17, 2013

(54) CONNECTOR

(75) Inventors: Naohiro Nakatsuji, Kariya (JP); Masao Tada, Kariya (JP); Shinichiro Komaki, Kariya (JP); Akihiro Tanaka, Yao (JP)

(73) Assignees: Toyota Boshoku Kabushiki Kaisha, Kariya-shi (JP); Hosiden Corporation, Yao-shi (JP)

( * ) Notice: Subject to any disclaimer, the term of this patent is extended or adjusted under 35 U.S.C. 154(b) by 28 days.

(21) Appl. No.: 13/306,016

(22) Filed: Nov. 29, 2011

(65) Prior Publication Data

US 2012/0208389 A1 Aug. 16, 2012

(30) Foreign Application Priority Data

Feb. 10, 2011 (JP) ..... 2011-026703

(51) Int. Cl.
*H01R 12/721* (2013.01)

(52) U.S. Cl.
USPC ..... 439/345

(58) Field of Classification Search
USPC ..... 439/345, 348, 370, 372, 729, 909
See application file for complete search history.

(56) References Cited

U.S. PATENT DOCUMENTS

| | | | | |
|---|---|---|---|---|
| 5,407,368 | A * | 4/1995 | Strand et al. | 439/729 |
| 5,538,444 | A * | 7/1996 | Strand et al. | 439/729 |
| 6,064,509 | A * | 5/2000 | Tonar et al. | 359/272 |
| 6,357,089 | B1 * | 3/2002 | Koguchi et al. | 24/536 |
| 7,311,560 | B2 * | 12/2007 | Ehr et al. | 439/729 |

FOREIGN PATENT DOCUMENTS

JP 2008-135222 A1 6/2008

* cited by examiner

*Primary Examiner* — Alexander Gilman
(74) *Attorney, Agent, or Firm* — Kratz, Quintos & Hanson, LLP

(57) ABSTRACT

The invention provides a connector including first and second conductive parts and a biasing device. The first and second conductive parts are opposed to each other so as to hold a flexible electric conductor therebetween. The first conductive part includes a locking hole or locking recess, and the second conductive part includes a locking projection of pointed shape. The locking projection is configured to pass through the electric conductor and be received in the locking hole or locking recess when the first and second conductive parts hold the electric conductor. The biasing device includes a clamp of generally C shape to hold the first and second conductive parts holding the electric conductor.

19 Claims, 14 Drawing Sheets

CONNECTOR

The present application claims priority under 35 U.S.C. §119 of Japanese Patent Application No. 2011-026703 filed on Feb. 10, 2011, the disclosure of which is expressly incorporated by reference herein in its entity.

BACKGROUND OF THE INVENTION

1. Field of the Invention

The present invention relates to connectors that are connectable to flexible electric conductors such as conductive fabrics.

2. Description of the Related Art

A conventional connector disclosed in Japanese Unexamined Patent Publication No. 2008-135222 includes first and second plates, coupled openably and closably, and a conductive metal plate fixed to the first plate. The conductive metal plate is provided with a plurality of claws to penetrate a locating tape (flexible electric conductor) to be received in a plurality of holes in the second plate. The claws of the conductive metal plate penetrate the locating tape, so that the conductive metal plate is electrically connected to the locating tape.

The connector maintains electrical connection with the locking claws on the first plate engaged with the locking holes in the second plate, by having the claws of the conductive metal plate penetrate the locating tape and inserting them into the holes of the second plate. When the locating tape is twisted, its flexibility may cause disengagement between the locking claws and the locking holes, so that the connector may lose electrical connection with the locating tape.

SUMMARY OF INVENTION

The present invention has been conceived in view of the above circumstances. The invention provides a connector that can maintain electrical connection with a flexible electric conductor even when the electric conductor is twisted.

A first connector of the present invention includes first and second conductive parts and a biasing device. The first and second conductive parts are opposed to each other so as to hold a flexible electric conductor therebetween. The first conductive part includes a locking hole or locking recess, and the second conductive part includes a locking projection of pointed shape. The locking projection is configured to pass through the electric conductor and be received in the locking hole or locking recess when the first and second conductive parts hold the electric conductor. The biasing device includes a clamp of generally C shape to hold the first and second conductive parts holding the electric conductor.

A second connector of the invention includes first and second conductive parts that are opposed to each other so as to hold a flexible electric conductor therebetween; first and second bodies fixed to the first and second conductive parts, respectively; and a biasing device including a clamp of generally C shape to hold the first and second conductive parts holding the electric conductor. At least one of the first body and the first conductive part has a locking hole or locking recess. At least one of the second body and the second conductive part has a locking projection of pointed shape. The locking projection is configured to pass through the electric conductor and be received in the locking hole or locking recess when the first and second conductive parts hold the electric conductor.

In the first and second connectors, the locking projection is configured to pass through the electric conductor and be received in the locking hole or recess when the first and second conductive parts hold the electric conductor. The first and second conductive parts, held by the clamp, can keep holding the electric conductor securely therebetween even when the electric conductor is twisted. In addition, the first and second connectors have improved tension strengths with respect to the electric conductor because the locking projection is configured to pass through the electric conductor and be received in the locking hole or the locking recess. Received in the locking hole or recess, the locking projection is less likely to deform if placed under tension by the electric conductor pulled.

The first connector may further include first and second bodies fixed to the first and second conductive parts, respectively. The first and second bodies may be provided with first and second accommodating recesses, respectively, to accommodate the biasing device. The second connector may also be configured such that the first and second bodies are provided with first and second accommodating recesses, respectively, to accommodate the biasing device.

According to these aspects of the invention, as the biasing device is accommodated in the first and second accommodating recesses of the first and second bodies, it is possible to prevent the interference of the biasing device from outside. It is thus possible to prevent accidental disengagement of the biasing device from the first and second conductive parts due to such interference from outside.

The first and second connectors may each further include an engaging mechanism. In this case, the first and second conductive parts may each further include a first face, being abuttable on the electric conductor, and a second face, being an opposite face of the first face. The clamp may include first and second arms being elastically abuttable on the second faces of the first and second conductive parts, respectively. The engaging mechanism may be configured to engage the first and second arms with the first and second conductive parts, respectively, in a state where the first and second arms elastically abut the second faces of the first and second conductive parts. According to this aspect of the invention, as the engaging mechanism can engage the first and second arms of the clamp with the first and second conductive parts in a state where the first and second arms elastically abut the second faces of the first and second conductive parts, the clamp has a further improved holding force with respect to the first and second conductive parts. As a result, the connectors have further improved tension strengths with respect to the electric conductor.

The engaging mechanism may include first and second steps, the first and second steps being provided in the first and second conductive parts, respectively, and configured to engage with the first and second arms, respectively. This aspect of the invention makes it possible to detachably attach the biasing device to the first and second conductive parts with ease because the biasing device can be engaged and fixed in position simply by having the first and second arms climb over the first and second steps.

The engaging mechanism may include first and second projections provided in the first and second conductive parts, respectively, and first and second holes provided in the first and second arms, respectively; or alternatively, the engaging mechanism may include first and second holes provided in the first and second conductive parts, respectively, and first and second projections provided in the first and second arms, respectively. In either case, the first and second projections may be configured to engage with the first and second holes. This aspect of the invention further improves a holding force of the clamp with respect to the first and second conductive parts because the first and second projections are engaged in the first and second holes.

At least one of the first and second conductive parts may further include a connecting portion that is connectable to a cable. This aspect of the invention eases the external connection of the connector through the use of the connecting portion to connect the cable.

The first body may include a hinge shaft and the second body may include a hinge hole, or alternatively the first body may include a hinge hole and the second body may include a hinge shaft. The hinge shaft may be configured to fit in the hinge hole and is of a tubular shape. The hinge shaft and the hinge hole may be configured to allow the cable to pass therethrough so as to connect the cable with the connecting portion.

This aspect of the invention eases the routing of the cable because the hinge shaft and the hinge hole allow the cable to pass therethrough and to connect to the connecting portion.

At least one of the first and second conductive parts may further include a holding portion to hold the cable. According to this aspect of the invention, the first and second connectors have improved tension strengths with respect to the cable because the cable is held in the holding portion.

The first faces of the first and second conductive parts may preferably be provided with projections. According to this aspect of the invention, as the projections on the first faces of the first and second conductive parts are brought into contact with the electric conductors, the first and second conductive parts have increased friction resistance with the electric conductor, improving the tension strengths of the first and second connectors with respect to the electric conductor. In addition, the projections on the first faces of the first and second conductive parts elastically contact with the electric conductor, so that the first and second conductive parts are stabilized in contact resistance value with respect to the electric conductor, thereby stabilizing the connection of the first and second connectors.

Each of the projections is preferably of square cone shape. According to this aspect of the invention, the increase in surface area of the projections further increases the friction resistance of the first and second conductive parts and thereby the tension strengths of the first and second connectors with respect to the electric conductor. In addition, the increase in surface areas of the projections stabilize the contact resistance value of the first and second conductive parts with respect to the electric conductor, thereby stabilizing the connection of the connectors.

A plurality of locking projections may be arranged outside the first face of the second conductive part. The locking hole or locking recess may include a plurality of locking holes or locking recess arranged in opposite outer ends of the first face of the first conductive part.

Each locking projection may be provided with a barb. According to this aspect of the invention, the barb makes the locking projection passed through the electric conductor less likely to fall off. Therefore, the first and second connectors have further improved tension strengths with respect to the electric conductor. In addition, when the barb is locked in the locking hole or recess, the first and second conductive parts will be further improved in holding force with respect to the electric conductor.

The first and second connectors may each further include a locking mechanism to lock the first body with the second body in the state where the first and second conductive parts hold the electric conductor therebetween. For example, the locking mechanism may include a locking claw provided on one of the first and second bodies, and a locking hole or locking recess formed in the other of the first and second bodies and configured to lock the locking claw in the state where the first and second conductive parts hold the electric conductor therebetween. According to these aspects of the invention, the locking mechanism locks the first body with the second body to maintain the state where the first and second conductive parts hold the electric conductor therebetween.

DESCRIPTION OF EMBODIMENTS

The following is a detailed description of first and second embodiments of the present invention. This is for illustrative purposes only, and not limitation.

First Embodiment

Figure 1A:
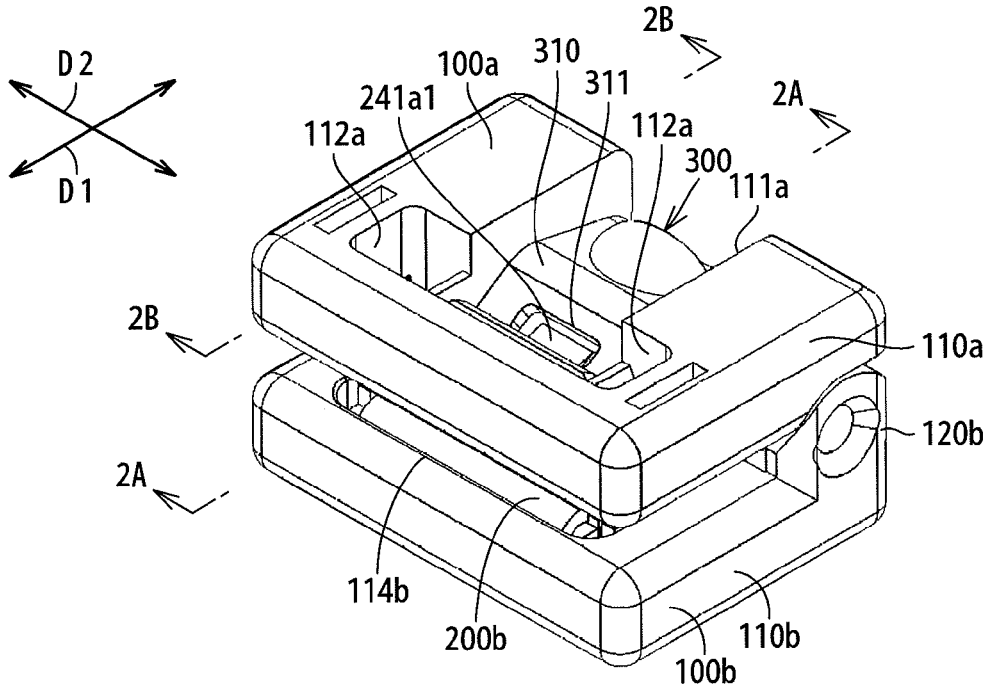
FIG. 1A is a front top right perspective view of a connector in a closed state according to a first embodiment of the present invention.
Figure 1B:
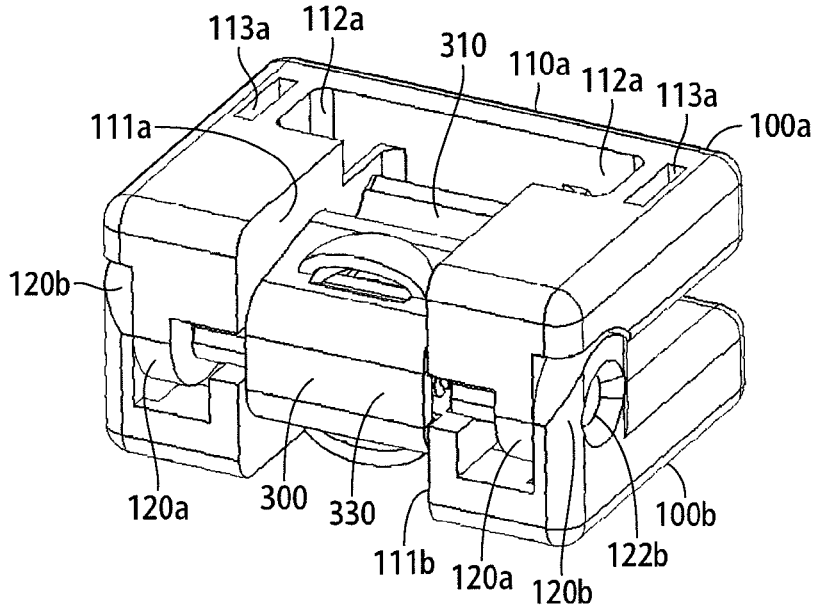
FIG. 1B is a rear top left perspective view of the connector in the closed state.
Figure 1C:
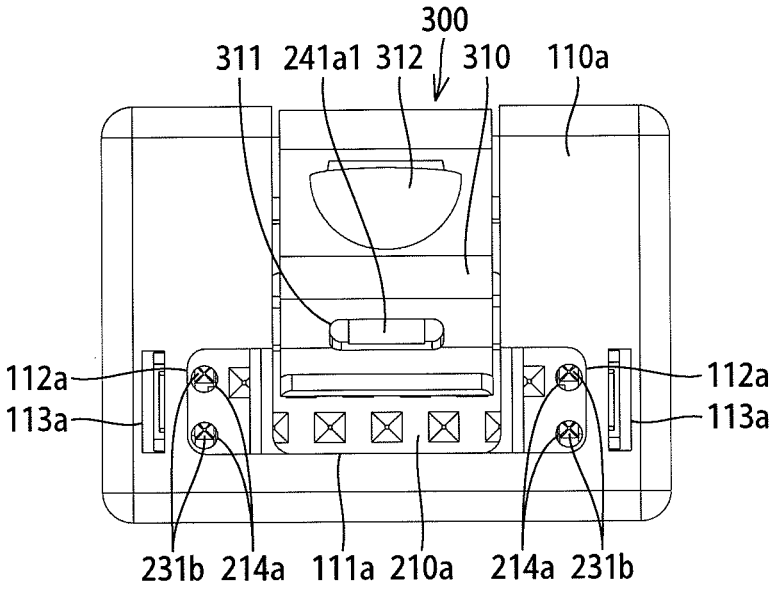
FIG. 1C is a plan view of the connector in the closed state.
Figure 1D:
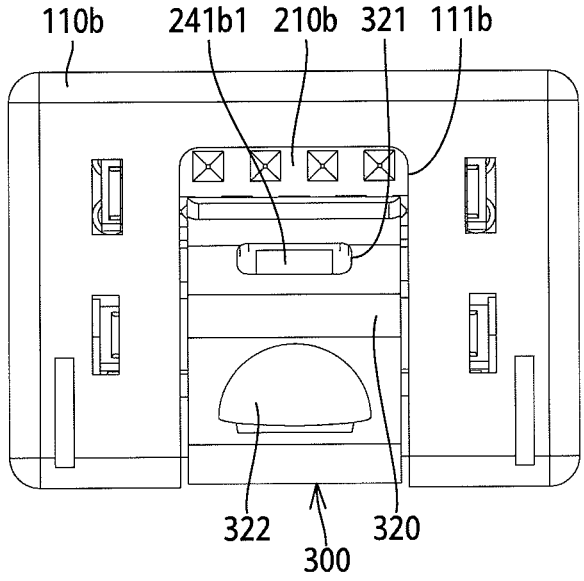
FIG. 1D is a bottom view of the connector in the closed state.
Figure 1E:
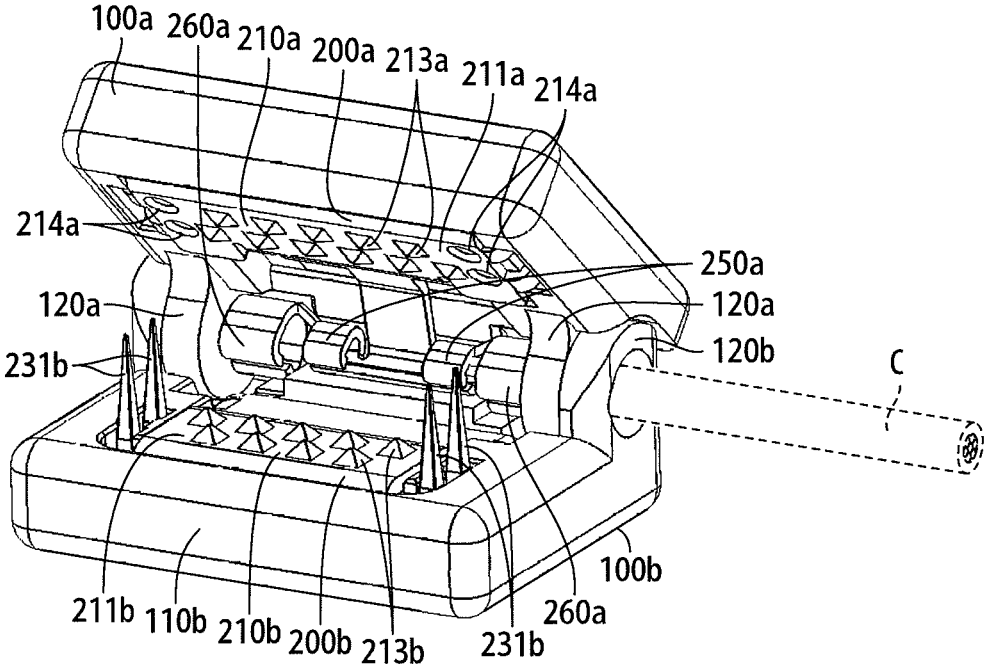
FIG. 1E is a front top right perspective view of the connector in an open state.
Figure 2A:
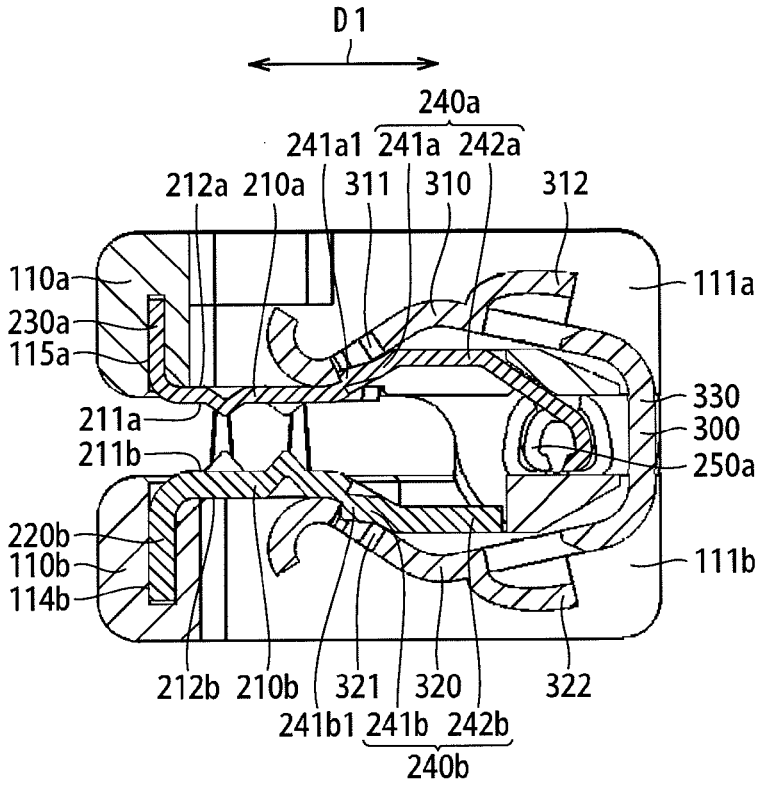
FIG. 2A is a cross-sectional view of the connector taken along line 2A-2A in FIG. 1A.
Figure 2B:
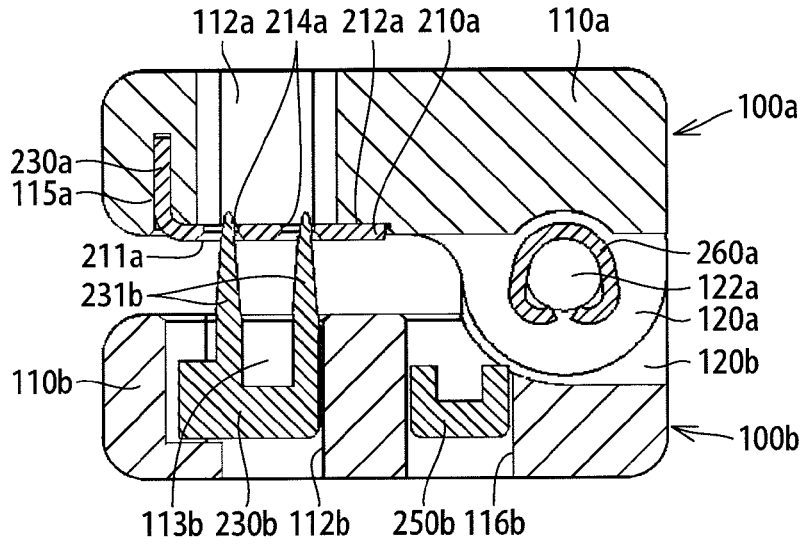
FIG. 2B is a cross-sectional view of the connector taken along line 2B-2B in FIG. 1A.

The first embodiment of the invention is described in detail below, with reference to FIGS. 1A to 8B. The connector herein is connectable to a flexible conductive fabric (electric conductor), not shown, and a cable C. As shown in FIGS. 1A to 2B, the connector includes bodies 100*a* and 100*b* (first and second bodies), conductive parts 200*a* and 200*b* (first and second conductive parts), and a spring clip 300 (biasing device). These elements of the connector will be described in detail below. It should be noted that FIGS. 1A, 2A, and 4 show directions D1 and D2 for the convenience of explanation of the first embodiment. D1 is a fore-and-aft direction of the connector, and D2 is a lateral direction that is orthogonal to the fore-and-aft direction D1.

The body 100*a* is an injection mold product made of an insulating resin as shown in FIGS. 3A, 4, 5A, and 5B. The body 100*a* has a generally rectangular block 110*a* and a pair of ring-shaped hinge protrusions 120*a*. A rectangular accommodating recess 111*a* is formed in a center of the block 110*a*. The accommodating recess 111*a* passes through the block 110*a* in its thickness direction such that a rear side in the fore-and-aft direction D1 of the block 110*a* is open. A pressing portion 111*a*1 bridges rear ends of walls extending in the fore-and-aft direction D1 of the accommodating recess 111*a*. An upper face of the pressing portion 111*a*1 slopes downward to the rear side in the fore-and-aft direction D1. The pressing portion 111*a*1 is to be disposed on the rear side in the fore-and-aft direction D1 of a step 240*a* (to be described) of the conductive part 200*a*.

Figure 5A:
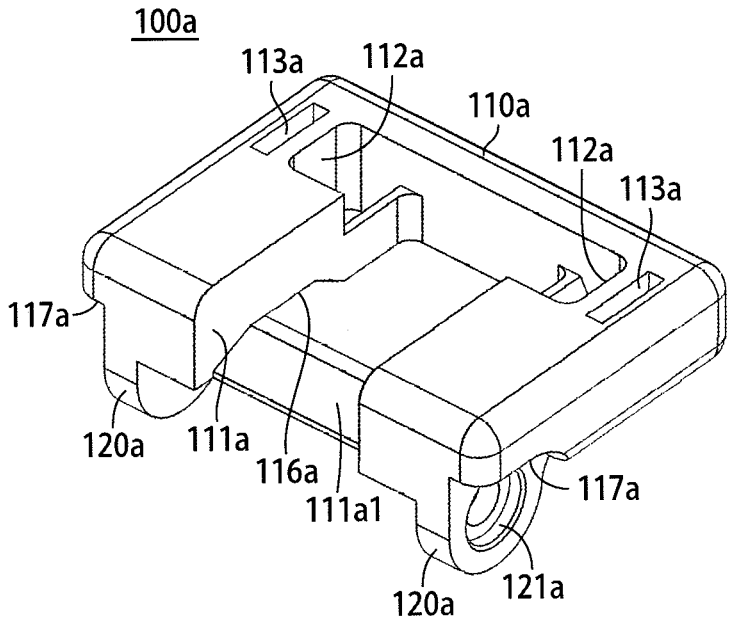
FIG. 5A is a rear top left perspective view of the first body of the connector.
Figure 5B:
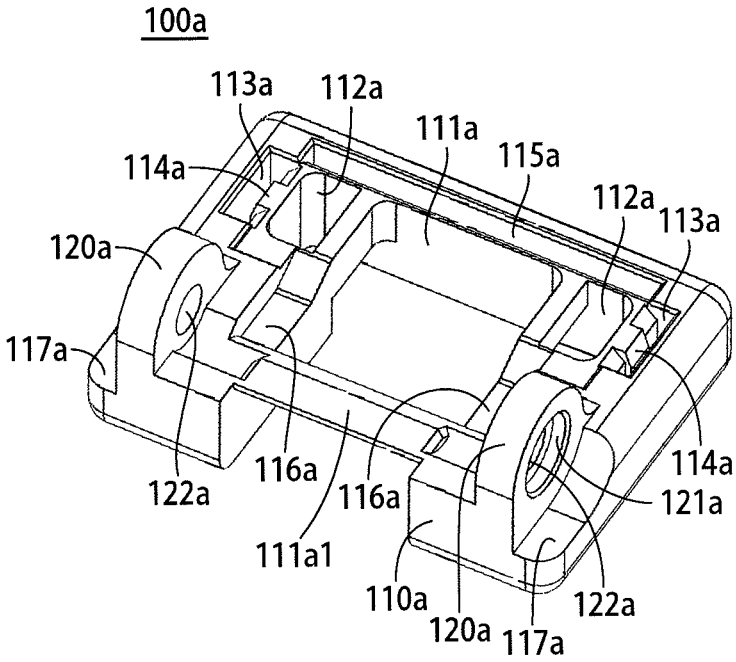
FIG. 5B is a rear bottom right perspective view of the first body of the connector.

A pair of generally rectangular through holes 112*a* is formed outside the accommodating recess 111*a* at a front end of the block 110*a*, passing through the block 110*a* in the thickness direction. Outside the through holes 112*a* of the block 110*a* is formed a pair of generally rectangular locking slits 113*a* passing through the block 110*a* in the thickness direction. As shown in FIG. 5B, the locking slits 113*a* have protrusions 114*a* on their respective walls on the inner side. A rectangular front slit 115*a* is formed in front of the accommodating recess 111*a* and the through holes 112*a* of the block 110*a*. A pair of side recesses 116*a* is formed behind the through holes 112*a* of the block 110*a* and in communication with the accommodating recess 111*a*. In rear corners in the rear side in the fore-and-aft direction D1 of the block 110*a*, a pair of indentions 117*a* is formed to avoid the interference of the block 110*a* with hinge protrusions 120*b* (to be described) of the body 100*b*.

The pair of hinge protrusions 120*a* are located inside the indentions 117*a* in the rear end of the block 110*a*. The hinge protrusions 120*a* centrally have hinge holes 121*a* and insertion holes 122*a*, with the insertion holes located inside the hinge protrusions 120*a*. The hinge holes 121*a* and the insertion holes 122*a* are concentric and communicate with each other. The hinge holes 121*a* and the insertion holes 122*a* serve as through holes in the lateral direction D2 of the hinge protrusions 120*a*. The inside diameter of the insertion holes 122*a* is smaller than the inside diameter of the hinge holes 121*a* and is slightly larger than the outside diameter of the cable C. In other words, the cable C is insertable into the hinge hole 121*a* and the insertion hole 122*a* as shown in FIG. 1E.

The body 100*b* is an injection mold product made of an insulating resin as shown in FIGS. 3B, 4, 6A, and 6B. The body 100*b* has a generally rectangular block 110*b* and the pair of ring-shaped hinge protrusions 120*b*. A rectangular accommodating recess 111*b* is formed in the center of the block 110*b*. The accommodating recess 111*b* passes through the block 110*b* in its thickness direction such that a rear side in the fore-and-aft direction D1 of the block 110*b* is open. A pressing portion 111*b*1 bridges rear ends of walls extending in the fore-and-aft direction D1 of the accommodating recess 111*b*. A lower face of the pressing portion 111*b*1 slopes upward to the rear side in the fore-and-aft direction D1. The pressing portion 111*b*1 is to be disposed on the rear side in the fore-and-aft direction D1 of a step 240*b* (to be described) of the conductive part 200*b*.

Figure 6A:
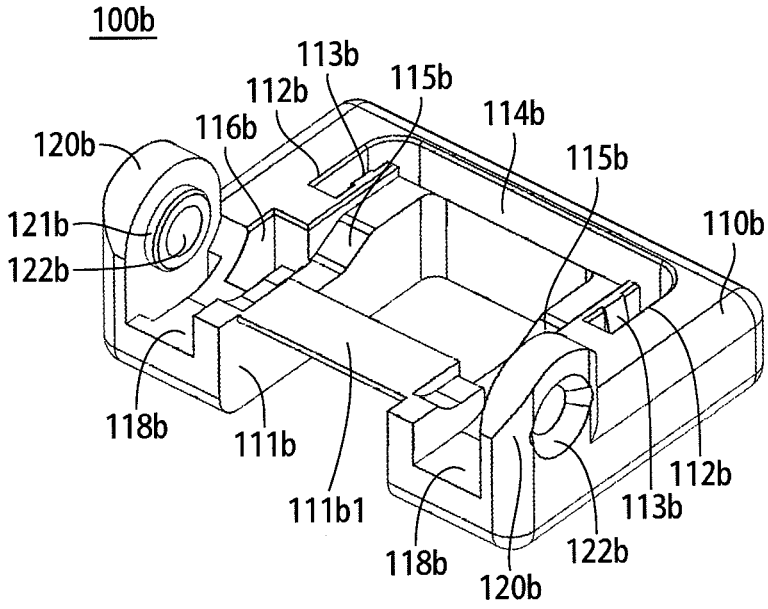
FIG. 6A is a rear top left perspective view of the second body of the connector.
Figure 6B:
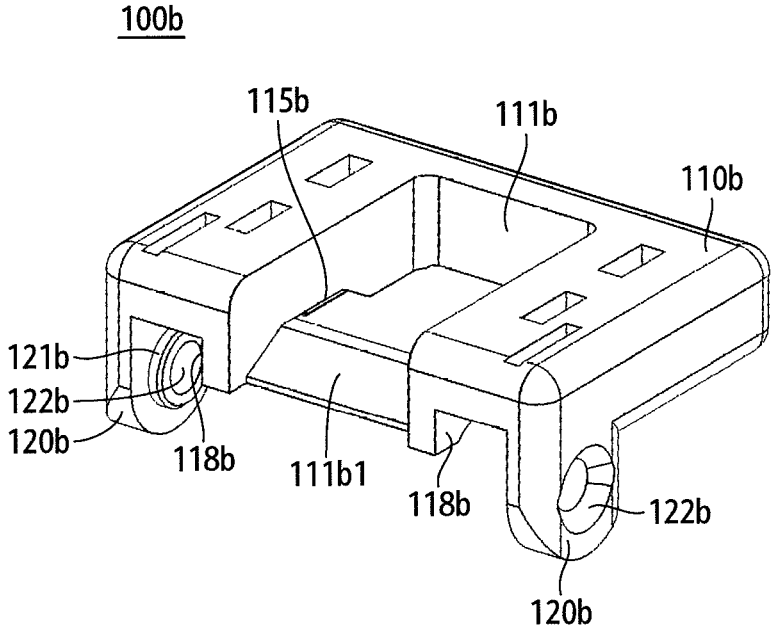
FIG. 6B is a rear bottom right perspective view of the second body of the connector.
Figure 7A:
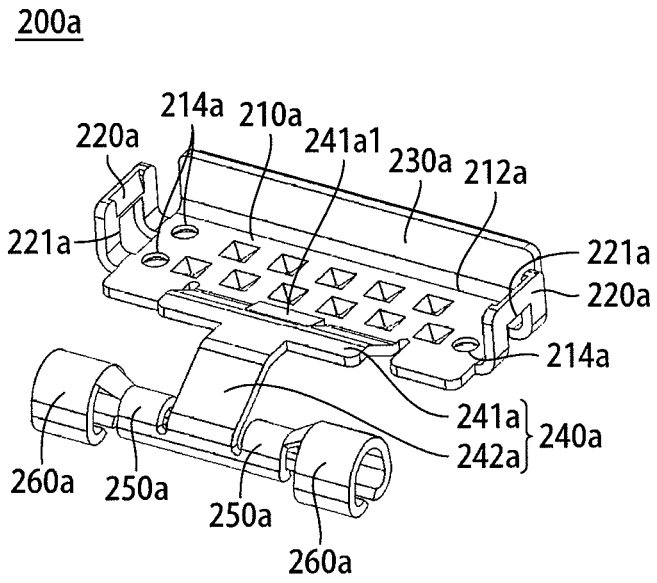
FIG. 7A is a rear top left perspective view of the first conductive part of the connector.
Figure 7B:
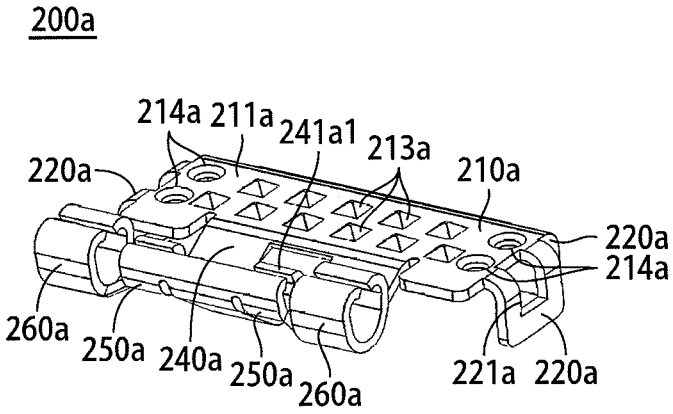
FIG. 7B is a rear bottom right perspective view of the first conductive part of the connector.
Figure 8A:
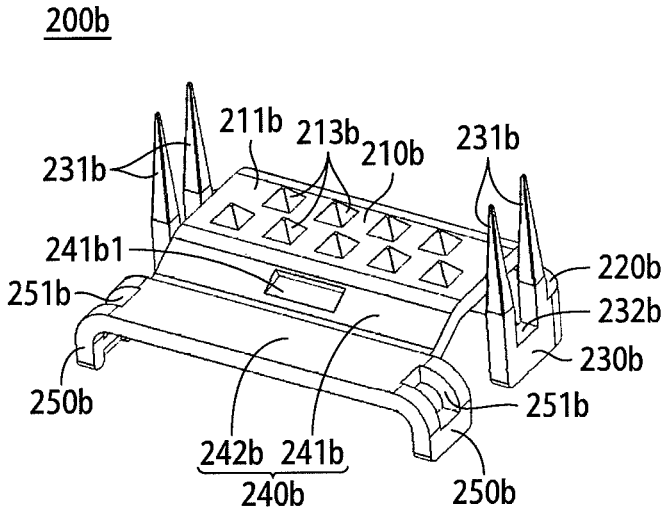
FIG. 8A is a rear top left perspective view of the second conductive part of the connector.
Figure 8B:
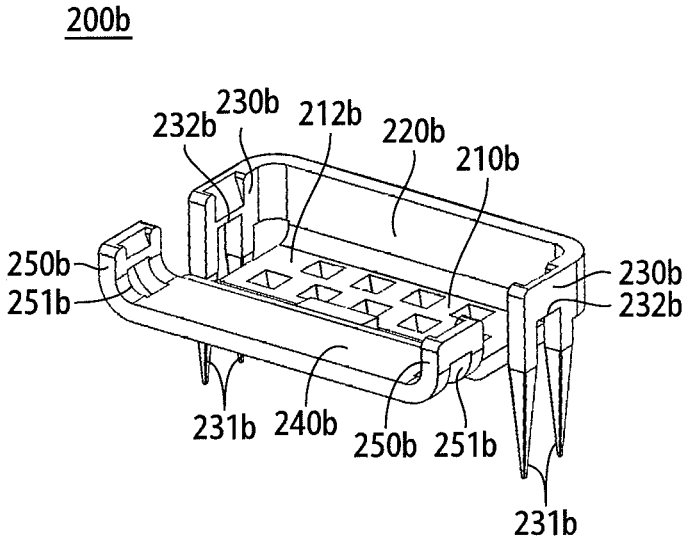
FIG. 8B is a rear bottom right perspective view of the second conductive part of the connector.

A pair of generally rectangular front locking holes 112*b* is formed outside the accommodating recess 111*b* at a front end of the block 110*b*, passing through the block 110*b* in the thickness direction. As shown in FIGS. 4 and 6A, the front locking holes 112*b* have front protrusions 113*b* on their respective walls on the inner side. A rectangular front slit 114*b* is formed in front of the accommodating recess 111*b* and the front locking holes 112*b* of the block 110*b*. Outer ends of the front slit 114*b* communicate with the respective front locking holes 112*b*. In the middle of the block 110*b*, there is formed a pair of side recesses 115*b* outside the accommodating recess 111*b* and in communication with the accommodating recess 111*b*. Further, a pair of generally rectangular rear locking holes 116*b* are provided outside the side recesses 115*b* of the block 110*b*. The rear locking holes 116*b* have rear protrusions 117*b* on their respective walls on the inner side as shown in FIG. 3B. Behind the rear locking holes 116*b* of the block 110*b*, a pair of hollows 118*b* is formed to avoid the interference of the block 110*b* with the hinge protrusions 120*a* of the body 100*a*.

The pair of hinge protrusions 120*b* are located outside the hollows 118*b* of the block 110*b*. The distance between the inner faces of the hinge protrusions 120*b* is substantially the same as the distance between the outer faces of the hinge protrusions 120*a*. Tubular hinge shafts 121*b* project from the inner faces of the hinge protrusions 120*b*. When the hinge shafts 121*b* fit into the hinge holes 121*a* of the hinge protrusions 120*a*, the bodies 100*a* and 100*b* will be hinged together openably and closably. FIGS. 1A and 1B show a closed state of the bodies 100*a* and 100*b* (that is, a closed state of the connector), and FIG. 1E shows an open state of the bodies 100*a* and 100*b* (that is, an open state of the connector). The hinge protrusions 120*b* have receiving holes 122*b* passing through the hinge protrusions 120*b* and the hinge shafts 121*b* in the lateral direction D2. The inside diameter of the receiving holes 122*b* is slightly larger than the outside diameter of the cable C, so that the cable C is insertable into the insertion holes 122*b* as shown in FIG. 1E.

Figure 3A:
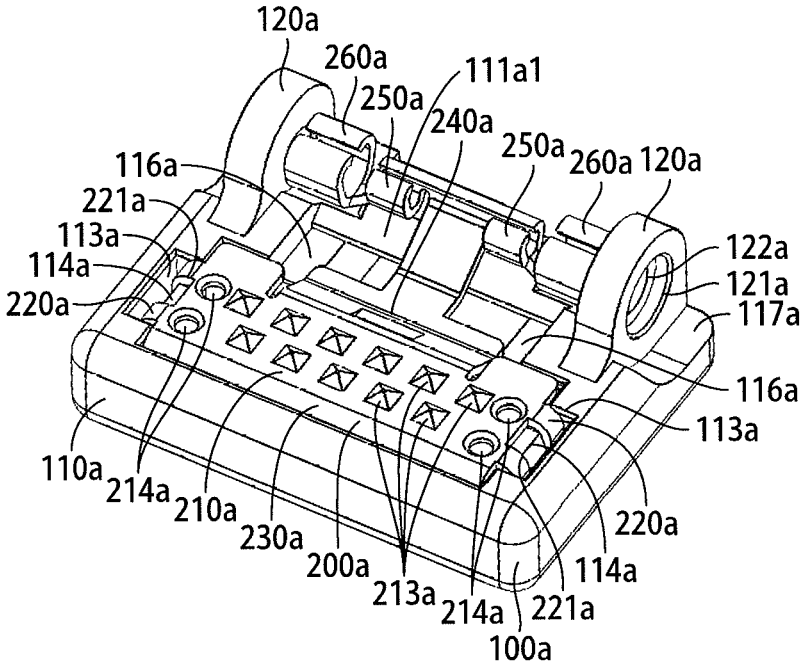
FIG. 3A is a front bottom left perspective view of a first body and a first conductive part of the connector.
Figure 3B:
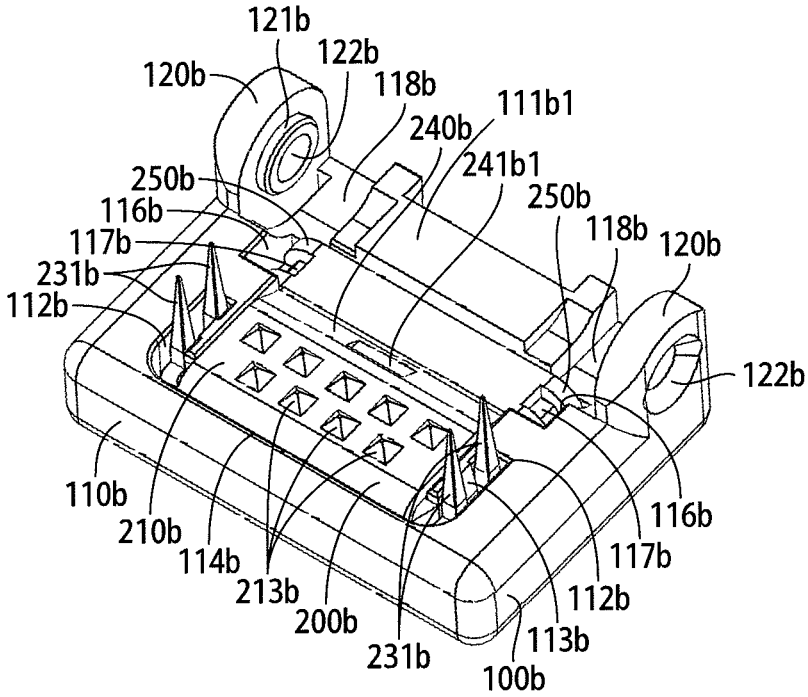
FIG. 3B is a front top right perspective view of a second body and a second conductive part of the connector.
Figure 4:
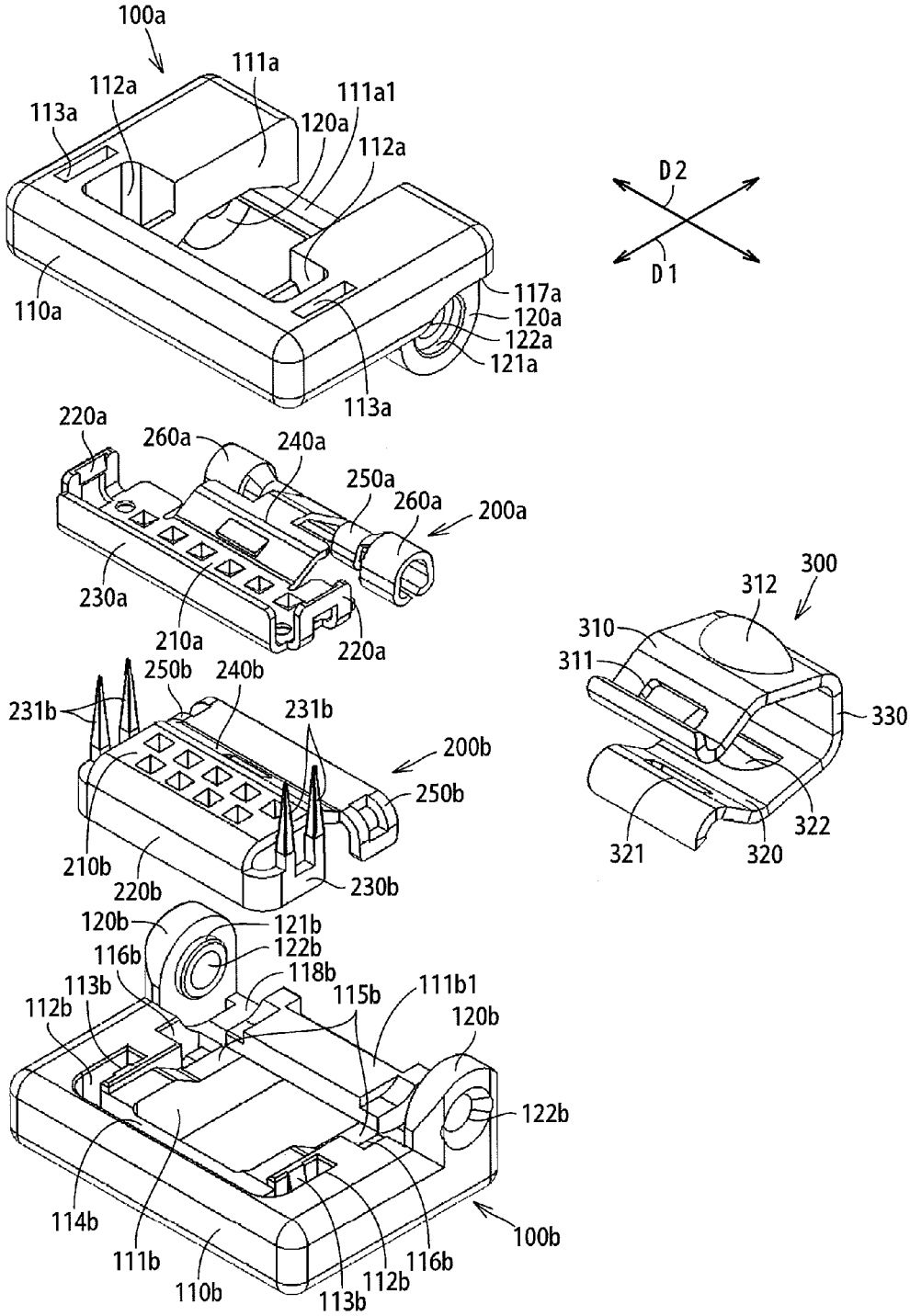
FIG. 4 is an exploded, front top right perspective view of the connector.

As shown in FIGS. 3A, 4, 7A, and 7B, the conductive part 200*a* is configured of a metal plate having electrical conductivity. The conductive part 200*a* has a main plate 210*a*, side locking pieces 220*a*, a front plate 230*a*, the step 240*a* (a first step of an engaging mechanism), a pair of connecting portions 250*a*, and a pair of holding portions 260*a*. The main plate 210*a* is a generally rectangular plate, and it has a first face 211*a* (a first face of the first conductive part) and a second face 212*a* (a second face of the first conductive part) being the opposite face of the first face 211*a*. The first face 211*a* is to be brought into contact with the conductive fabric. A plurality of projections 213*a* of square pyramid shape are disposed in a zigzag manner in the middle of the first face 211*a*. Two locking holes 214*a*, aligned in the fore-and-aft direction D1, are formed in each end in the lateral direction D2 of the main plate 210*a* (each end of the first face 211*a*) As shown in FIG. 3A, the main plate 210*a* is placed on an inner face (i.e. the face facing the body 100*b*) of the body 100*a* so as to cover the front portion in the fore-and-aft direction D1 of the accommodating recess 111*a* and the pair of through holes 112*a*. The second face 212*a* of the main plate 210*a* is partly exposed, particularly in the middle through the accommodating recess 111*a* and in the opposite ends in the lateral direction D2 through holes 112*a*. The locking holes 214*a* of the main plate 210*a* communicate with the through holes 112*a*.

The pair of side locking pieces 220*a* are provided at ends in the lateral direction D2 of the main plate 210*a*. The side locking pieces 220*a* are bent substantially at a right angle to the main plate 210*a* and extend upward. Generally rectangular locking holes 221*a* are formed centrally in the side locking pieces 220*a*. The side locking pieces 220*a* are to be inserted into the locking slits 113*a* of the body 100*a*, while the protrusions 114*a* of the body 100*a* are to be locked in the locking holes 221*a* of the side locking pieces 220*a*, such that the conductive part 200*a* is fixed inside the body 100*a*.

The front plate 230*a* is provided at a distal end of the main plate 210*a*. The front plate 230*a* is bent substantially at a right angle to the main plate 210*a* and extends upward, i.e. in the same direction as the side locking pieces 220*a*. The front plate 230*a* is to be inserted into the front slit 115*a* of the body 100*a*.

The step 240*a* is continuous with a rear end of the main plate 210*a*. The step 240*a* has an inclined plate 241*a* and an arm plate 242*a*. The inclined plate 241*a* extends at an angle to the main plate 210*a* and slopes upward to the rear side of the fore-and-aft direction D1 (see FIG. 2A). The inclined plate 241*a* is accommodated at its end portions in the lateral direction D2 in the side recesses 116*a* of the body 100*a* and exposed in its middle portion through the accommodating recess 111*a* of the body 100*a*. The middle portion of the inclined plate 241*a* is provided with a projected piece 241*a*1 (a first projection). The arm plate 242*a* is a rectangular plate continuous with the rear center of the inclined plate 241*a*, and it has a smaller width than the inclined plate 241*a* sloping downward to the rear side in the fore-and-aft direction D1. The arm plate 242*a* is also exposed through the accommodating recess 111*a*.

The pair of connecting portions 250*a* are tubularly curved plates continuous with opposite ends of the rear end of the step 240*a*. The outer sides of the connecting portions 250*a* are continuous with the holding portions 260*a*, which are tubularly curved plates. The connecting portions 250*a* and the holding portions 260*a* are arranged between the hinge protrusions 120*a* of the body 100*a* such that they are substantially concentric with the hinge holes 121*a* and the insertion holes 122*a* of the hinge protrusions 120*a*. In other words, the connecting portions 250*a*, the holding portions 260*a*, the hinge holes 121*a*, and the insertion holes 122*a* are arranged along the lateral direction D2 and communicate with each other. The inside diameters of each connecting portion 250*a* is slightly larger than the outside diameter of a core wire of the cable C. The inside diameter of each holding portion 260*a* is slightly larger than the outside diameter of the cable C. That is, as shown in FIG. 1E, the cable C is insertable into the holding portion 260*a*, and the core wire of the cable C is insertable into the connecting portion 250*a*.

As shown in FIGS. 3B, 4, 8A, and 8B, the conductive part 200*b* is configured of a metal plate having electrical conductivity. The conductive part 200*b* has a main plate 210*b*, a front plate 220*b*, a pair of side plates 230*b*, a step 240*b* (a second step of the engaging mechanism), and a pair of side locking pieces 250*b*. The main plate 210*b* is a generally rectangular plate, and it has a first face 211*b* (a first face of the second conductive part) and a second face 212*b* (a second face of the second conductive part) being the opposite face of the first face 211*b*. The first face 211*b* is to be brought into contact with the conductive fabric. A plurality of projections 213*b* of square pyramid shape are disposed in a zigzag manner on the first face 211*b*. As shown in FIG. 3B, the main plate 210*b* is placed on an inner face (i.e. the face facing the body 100*a*) of the body 100*b* so as to cover the front portion in the fore-and-aft direction D1 of the accommodating recess 111*b*. The first face 211*b* of the main plate 210*b* and the first face 211*a* of the main plate 210*a* are opposed to each other to each other so as to hold the conductive fabric therebetween. In addition, the second face 212*b* of the main plate 210*b* is exposed in its middle through the accommodating recess 111*b*.

The front plate 220*b* is provided at a distal end of the main plate 210*b*. The front plate 220*b* is bent substantially at a right angle to the main plate 210*b* and extends downward. The front plate 220*b* is inserted into the front slit 114*b* of the body 100*b*. The pair of side plates 230*b* are continuous with opposite ends of the front plate 220*b*. The side plates 230*b* are bent substantially at a right angle to the front plate 220*b* and extend to the rear side of the fore-and-aft direction D1. Two locking projections 231*b* of pointed shape, aligned in the fore-and-aft direction D1, extend to the conductive part 200*a* side (i.e. upward) from each of the side plates 230*b*. The locking projections 231*b* are located outside in the lateral direction D2 of the first face 211*b* of the main plate 210*b*, and they are insertable into the locking holes 214*a* of the conductive part 200*a* and further into the through holes 112*a* of the body 100*a* (see FIG. 2B). As shown in FIG. 3B, the side plates 230*b* are to be inserted into the front locking holes 112*b* of the body 100*b*, while the front protrusions 113*b* of the body 100*b* are to be locked in locking portions 232*b*, spaces between the locking projections 231*b* of the side plates 230*b*.

The step 240*b* is continuous with a rear end of the main plate 210*b*. The step 240*b* has an inclined plate 241*b* and a horizontal plate 242*b*. The inclined plate 241*b* extends at an angle to the main plate 210*b* and slopes downward to the rear side of the fore-and-aft direction D1 (see FIG. 2A). The middle portion of the inclined plate 241*b* is provided with a projected piece 241*b*1 (a second projection). The horizontal plate 242*b* is a rectangular plate continuous with a rear end of the inclined plate 241*b*, and it extends to the rear side of the fore-and-aft direction D1. The end portions in the lateral direction D2 of the inclined plate 241*b* and horizontal plate 242*b* are accommodated in the side recesses 115*b* of the body 100*b*, while the middle portions thereof are exposed through the accommodating recess 111*b* of the body 100*b*.

The pair of side locking pieces 250*b* are continuous with opposite ends of the horizontal plate 242*b*. The side locking pieces 250*b* are bent substantially at a right angle to the horizontal plate 242*b* and extend downward. The side locking pieces 250*b* have generally rectangular locking holes 251*b* in the center. As shown in FIG. 3B, the side locking pieces 250*b* are to be inserted into the rear locking holes 116*b* of the body 100*b*, while the rear protrusions 117*b* of the body 100*b* are to be locked in the locking holes 251*b* of the side locking pieces 250*b*. The side plates 230*b* are to be locked in the front locking holes 112*b*. The side locking pieces 250*b* are to be locked in the rear locking holes 116*b*, such that the conductive part 200*b* is fixed inside the body 100*b*.

The spring clip 300 (clamp of the biasing device) is a generally C-shaped metal plate having electrical conductivity as shown in FIGS. 1A to 1D, 2A, and 4. The spring clip 300 has a first arm 310, a second arm 320, and an intermediate portion 330. The intermediate portion 330 is a generally rectangular plate. The first arm 310 and the second arm 320 are plates each having a base end, an inclined portion, and a distal end. A distance in the fore-and-aft direction D1 from the distal end of the first arm 310 to a rear end face of the intermediate portion 330 is smaller than a length in the fore-and-aft direction D1 of the accommodating recess 111*a* of the body 100*a*, and a distance in the fore-and-aft direction D1 from the distal end of the second arm 320 to a rear end face of the intermediate portion 330 is smaller than a length in the fore-and-aft direction D1 of the accommodating recess 111*b* of the body 100*b*. In addition, each length in the lateral direction D2 of the first arm 310, the second arm 320, and the intermediate portion 330 is smaller than each length in the lateral direction D2 of the accommodating recesses 111*a* and 111*b* of the bodies 100*a* and 100*b*. That is, the first arm 310, the second arm 320, and the intermediate portion 330 can be accommodated in the accommodating recesses 111*a* and 111*b* in a locked state (to be described).

The base end of the first arm 310 is a plate continuous with an upper end of the intermediate portion 330 and provided with a semispherical operation protrusion 312, while the base end of the second arm 320 is a plate continuous with a lower end of the intermediate portion 330 and provided with a semispherical operation protrusion 322. The operation protrusions 312 and 322 are operable to elastically deform the spring clip 300 and open the first arm 310 and the second arm 320. The inclined portions of the first and second arms 310 and 320 are plates continuous with the base ends and are inclined in directions close to each other, and they are provided with rectangular holes 311 and 321 (first and second holes of the engaging mechanism), respectively.

The distal ends of the first and second arms 310 and 320 are plates continuous with the inclined portions and are curved in directions away from each other. The distance between the apexes of the distal ends of the first and second arms 310 and 320 is smaller than the sum of a thickness of the main plate 210*a* of the conductive part 200*a*, a thickness of the main plate 210*b* of the conductive part 200*b*, and a thickness of the conductive fabric. When the first and second arms 310 and 320 are inserted into the accommodating recesses 111*a* and 111*b* in the state where the conductive fabric is held between the main plate 210*a* of the conductive part 200*a* and the main plate 210*b* of the conductive part 200*b*, the first arm 310 and the second arm 320 climb over the pressing portions 111*a*1 and 111*b*1 and the steps 240*a* and 240*b* and elastically abut the second faces 212*a* and 212*b* of the main plates 210*a* and 210*b*. As a result, the conductive parts 200*a* and 200*b* are elastically held by the spring clip 300. In this state (hereinafter referred to as a locked state), the inclined portions of the first and second arms 310 and 320 are engaged with the steps 240*a* and 240*b* of the conductive parts 200*a* and 200*b*, and the projected pieces 241*a*1 and 241*b*1 of the steps 240*a* and 240*b* are engaged in the holes 311 and 321 of the first and second arms 310 and 320.

The following paragraphs describes in detail the steps of assembling the connector of the above configuration (except for steps of attaching the spring clip 300). The first step is to prepare the body 100*a* made by a known injection molding method and the conductive part 200*a* made by a known press molding method. The next step is to insert the side locking pieces 220*a* of the conductive part 200*a* into the associated locking slits 113*a* of the body 100, and to insert the front plate 230*a* of the conductive part 200*a* into the front slit 115*a* of the body 100*a*. Then, the protrusions 114*a* in the locking slits 113*a* are locked into the locking holes 221*a* of the side locking pieces 220*a*. At this time, the main plate 210*a* of the conductive part 200*a* is placed on the inner face (the face facing the body 100*b*) of the body 100*a* so as to cover the front portion of the accommodating recess 111*a* and the through holes 112*a*, and the ends of the inclined plate 241*a* of the conductive part 200*a* are accommodated in the side recesses 116*a* of the body 100*a*. In addition, the connecting portions 250*a* and the holding portions 260*a* of the conductive part 200*a* are placed between the hinge protrusions 120*a* of the body 100*a*.

Also prepared are the body 100*b* made by a known injection molding method and the conductive part 200*b* made by a known press molding method. Thereafter, the front plate 220*b* of the conductive part 200*b* is inserted into the front slit 114*b* of the body 100*b*, the side plates 230*b* of the conductive part 200*b* are inserted into the associated front locking holes 112*b* of the body 100*b*, and the side locking pieces 250*b* of the conductive part 200*b* are inserted into the associated rear locking holes 116*b* of the body 100*b*. Then, the front protrusions 113*b* inside the front locking holes 112*b* are locked into the locking portions 232*b* of the side plates 230*b*, and the rear protrusions 117*b* inside the rear locking holes 116*b* are locked into the locking holes 251*b* of the side locking pieces 250*b*. At this time, the main plate 210*b* is placed on the inner face of the body 100*b* so as to cover the front portion of the accommodating recess 111*b*, and the ends of the inclined plate 241*b* and the horizontal plate 242*b* (i.e. the ends of the step 240*b*) are accommodated in the side recesses 115*b* of the body 100*b*.

Thereafter, the hinge shafts 121*b* of the body 100*b* are fitted into the hinge holes 121*a* of the body 100*a*. Consequently, the bodies 100*a* and 100*b* are hinged in an openable and closable manner.

Thereafter, the bodies 100*a* and 100*b* are brought into the open state. Thereafter, the cable C is inserted into one of the insertion holes 122*b* of the body 100*b*, the associated hinge hole 121*a* and the insertion hole 122*a* of the body 100*a*, and the associated one of the holding portions 260*a* of the conductive part 200*a*, and the core wire of the cable C is inserted into at least one of the connecting portions 250*a* of the conductive part 200*a*. Thereafter, the holding portion 260*a* and the connecting portion 250*a* are swaged, so that the cable C is held in the holding portion 260*a*, and the core wire is held in and electrically connected to the connecting portion 250*a*. Thereafter, the core cable and the connecting portion 250*a* may be soldered together.

The following paragraphs describe how to connect the conductive fabric to the connector and how to attach the spring clip 300. First, the conductive fabric is inserted between the bodies 100*a* and 100*b* in the open state, and then the bodies 100*a* and 100*b* are closed. Then, the conductive fabric is sandwiched between the main plate 210*a* of the conductive part 200*a* and the main plate 210*b* of the conductive part 200*b*. At this time, the locking projections 231*b* of the conductive part 200*b* penetrate the conductive fabric and pass through the locking holes 214*a* of the conductive part 200*a* and into the through holes 112*a* of the body 100*a*.

Thereafter, the first and second arms 310 and 320 of the spring clip 300 are inserted into the accommodating recesses 111*a* and 111*b* of the bodies 100*a* and 100*b*, respectively. Then, the first and second arms 310 and 320 are pressed by the pressing portions 111*a*1 and 111*b*1 in the accommodating recesses 111*a* and 111*b*, and they elastically deform in the directions away from each other. When the first and second arms 310 and 320 climb over the pressing portions 111*a*1 and 111*b*1 and the steps 240*a* and 240*b* of the conductive parts 200*a* and 200*b*, the distal ends of the first and second arms 310 and 320 elastically abut the second faces 212*a* and 212*b* of the main plates 210*a* and 210*b* of the conductive parts 200*a* and 200*b*. Simultaneously, the first and second arms 310 and 320 are engaged with the steps 240*a* and 240*b* of the conductive parts 200*a* and 200*b*, and the projected pieces 241*a*1 and 241*b*1 of the steps 240*a* and 240*b* are engaged into the holes 311 and 321 of the f first and second arms 310 and 320. Consequently, the spring clip 300 is attached to the conductive parts 200*a* and 200*b* to elastically hold the conductive parts 200*a* and 200*b* holding the conductive fabric therebetween.

To detach the spring clip 300, the operation protrusions 312 and 322 are pressed to elastically deform and open the first and second arms 310 and 320. The deformed first and second arms 310 and 320 are disengaged from the steps 240*a* and 240*b*, and the projected pieces 241*a*1 and 241*b*1 of the steps 240*a* and 240*b* are disengaged from the holes 311 and 321 of the first arm 310 and the second arm 320. Thereafter, the spring clip 300 is pulled out of the accommodating recesses 111*a* and 111*b* of the bodies 100*a* and 100*b*.

Thereafter, the bodies 100*a* and 100*b* are pulled open. Then, the locking projections 231*b* of the conductive part 200*b* come out of the through holes 112*a* of the body 100*a*, the locking holes 214*a* of the conductive part 200*a*, and the conductive fabric. It is now possible to pull out the conductive fabric from between the main plate 210*a* of the conductive part 200*a* and the main plate 210*b* of the conductive part 200*b*.

In the connector as described above, when the main plate 210*a* of the conductive part 200*a* and the main plate 210*b* of the conductive part 200*b* hold the conductive fabric therebetween, the locking projections 231*b* of the conductive part 200*b* penetrate the conductive fabric and pass through the locking holes 214*a* of the conductive part 200*a* and into the through holes 112*a* of the body 100*a*. The conductive parts 200*a* and 200*b*, held by the spring clip 300, can keep securely holding the conductive fabric therebetween even when the conductive fabric is twisted.

Further, the present connector has an improved tension strength with respect to the conductive fabric because the locking projections 231*b* penetrate the conductive fabric and pass through the locking holes 214*a* of the conductive part 200*a*. The locking projections 231*b* received the locking holes 214*a* of the conductive part 200*a* are less likely to deform if placed under tension by the conductive fabric pulled. Further advantageously, the square pyramid shaped projections 213*a* and 213*b* of the first faces 211*a* and 211*b* of the conductive parts 200*a* and 200*b* elastically contact the conductive fabric, increasing the contact area of the first faces 211*a* and 211*b* of the conductive parts 200*a* and 200*b* with the conductive fabric. This increases friction resistance of the conductive parts 200*a* and 200*b* with respect to the conductive fabric, further improving the tension strength of the connector with respect to the conductive fabric. Further, the projections 213*a* and 213*b* of the conductive parts 200*a* and 200*b* elastically contact the conductive fabric to provide a stable contact resistance value with respect to the conductive fabric, improving the connection stability of the connector.

In addition, as the spring clip 300 is accommodated in the accommodating recesses 111*a* and 111*b* of the bodies 100*a* and 100*b*, it is possible to prevent the interference with the spring clip 300 from the outside of the bodies 100*a* and 100*b*. It is thus possible to prevent accidental disengagement of the spring clip 300 from the conductive parts 200*a* and 200*b* due to such interference from the outside.

Still advantageously, the connector is connected to the conductive fabric simply by the conductive parts 200*a* and 200*b* holding the conductive fabric therebetween, the locking projections 231*b* of the conductive part 200*b* penetrating the conductive fabric and passing through the locking holes 214*a* of the conductive part 200*a* and into the through holes 112*a* of the body 100*a*. With such configuration, it is easy to release the connection of the connector with the conductive fabric, simply by detaching the spring clip 300 and pulling open the bodies 100*a* and 100*b*. It is therefore easy to change the connection position of the connector with the conductive fabric, improving design flexibility. In addition, the spring clip 300 can be easily attached to and detached from the conductive parts 200*a* and 200*b* because it is possible to fix the spring clip 300 in position simply by having it climb over the steps 240*a* and 240*b* of the conductive parts 200*a* and 200*b* so as to be engaged with the steps 240*a* and 240*b*.

Second Embodiment

Figure 9A:
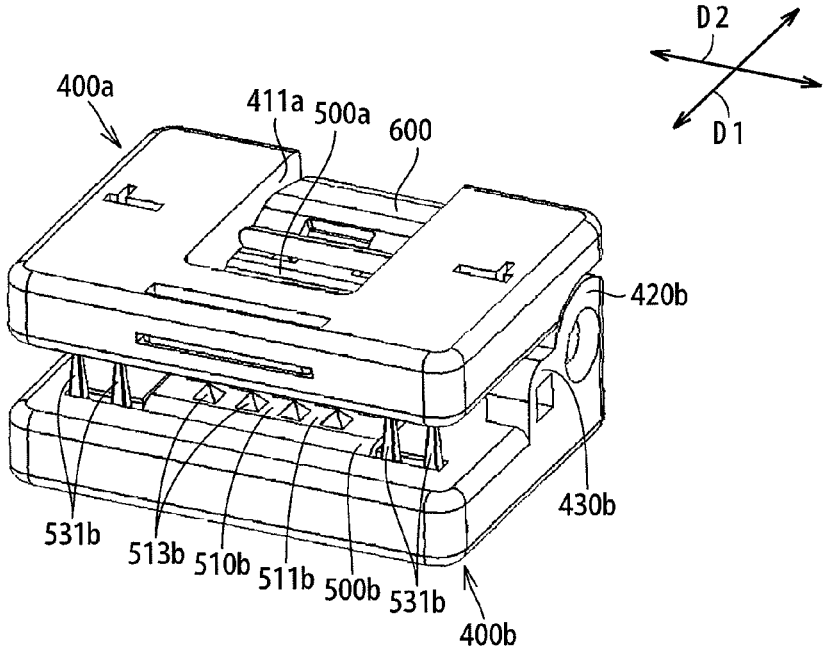
FIG. 9A is a front top right perspective view of a connector in a closed state according to a second embodiment of the invention.
Figure 9B:
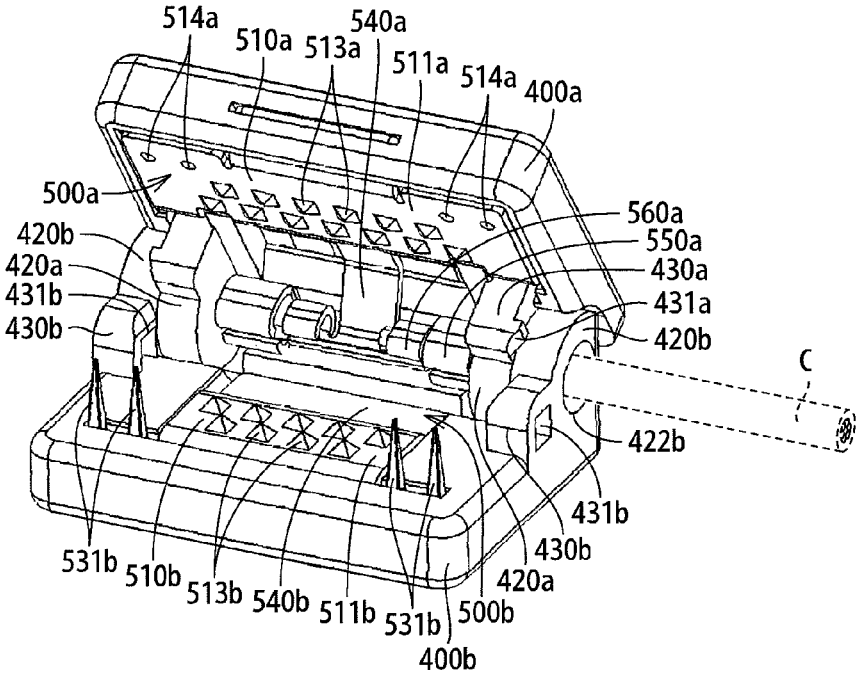
FIG. 9B is a front top right perspective view of the connector in an open state.
Figure 10A:
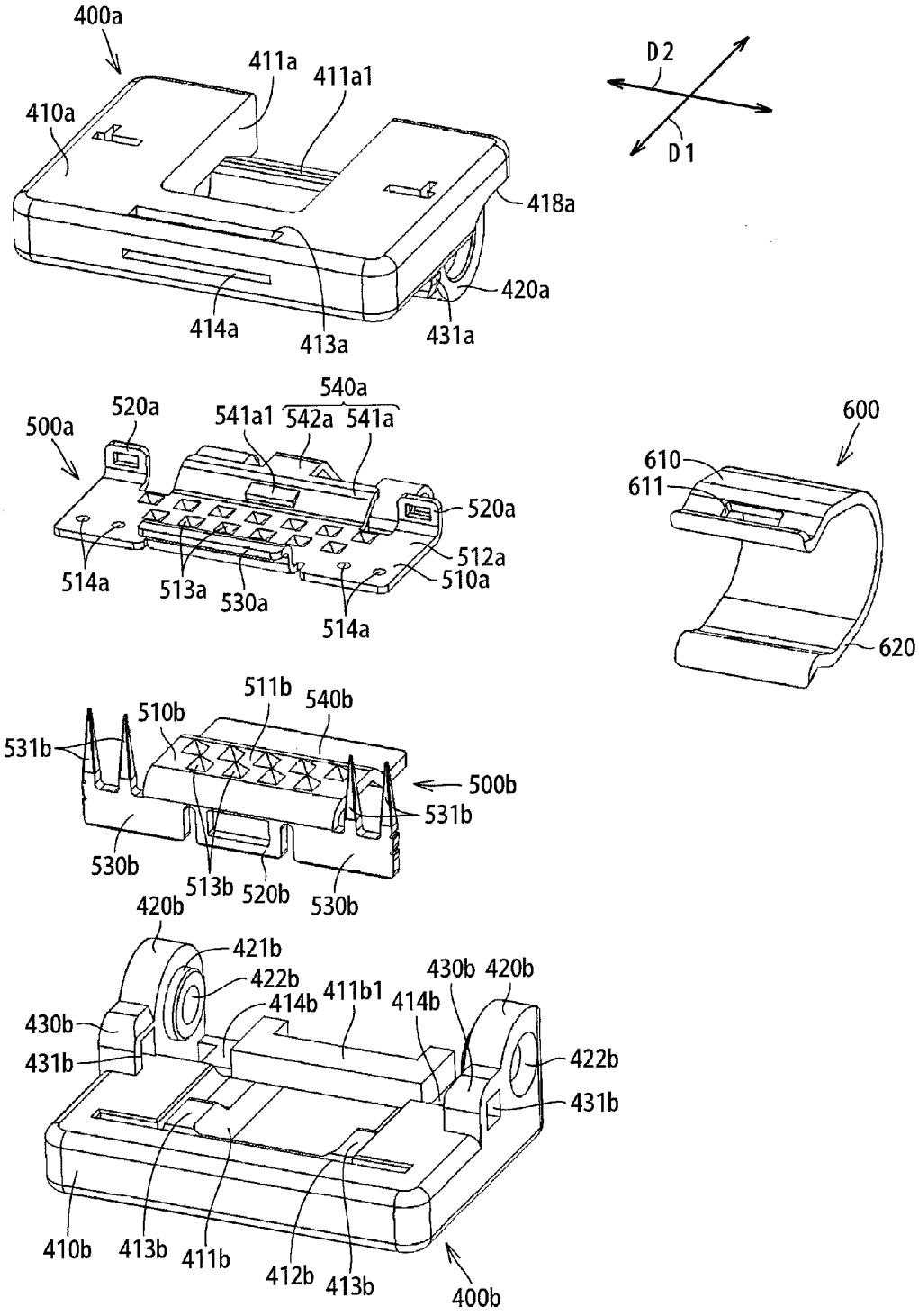
FIG. 10A is an exploded, front top right perspective view of the connector.
Figure 10B:
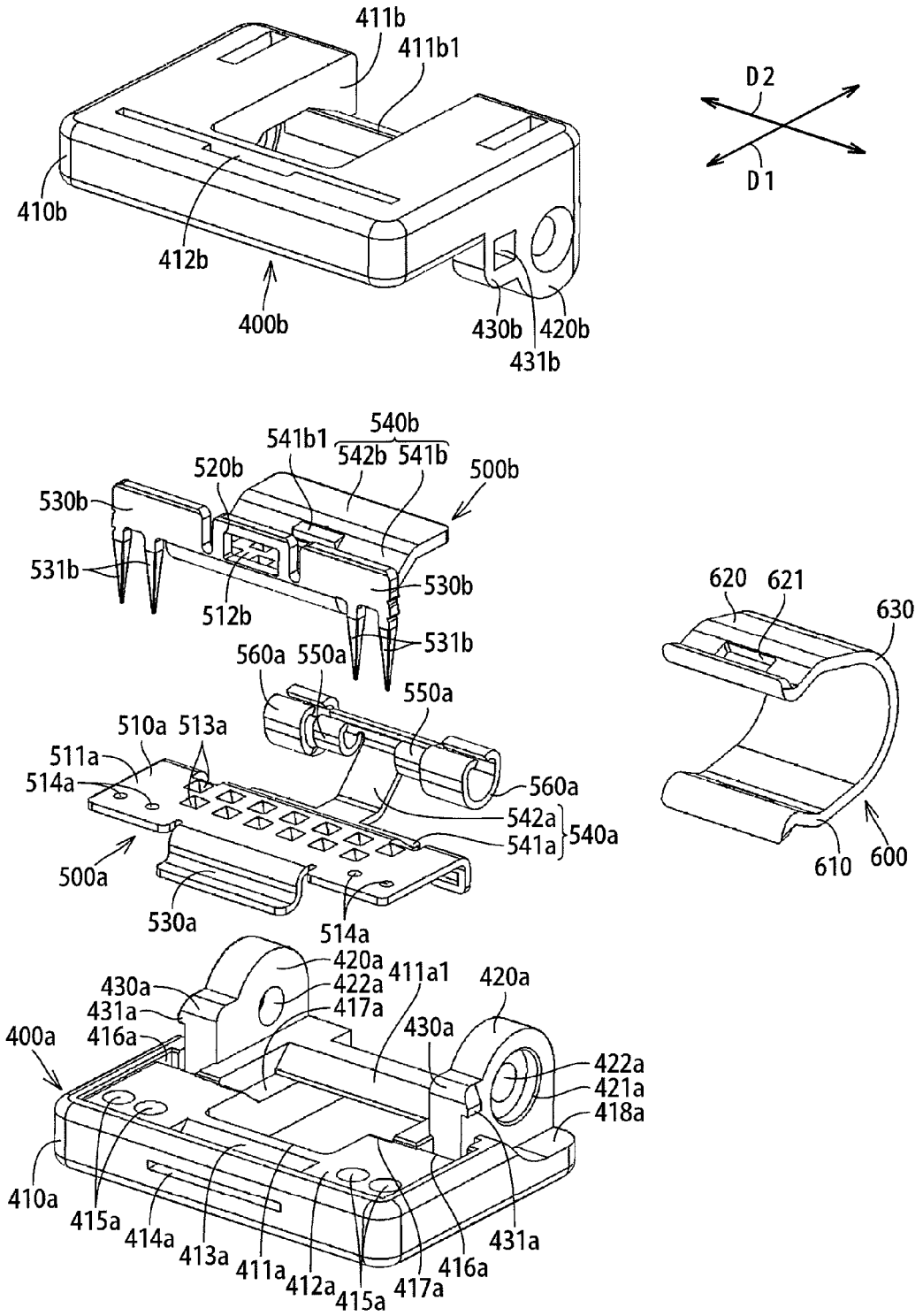
FIG. 10B is an exploded, front bottom left perspective view of the connector.

Next, a connector according to a second embodiment of the invention will be described with reference to FIGS. 9A to 11B. The connector herein is connectable to a flexible conductive fabric (electric conductor), not shown, and a cable C. As shown in FIGS. 9A and 9B, this connector includes bodies 400*a* and 400*b* (first and second bodies), conductive parts 500*a* and 500*b* (first and second conductive parts), and a spring clip 600 (biasing device). These elements of the connector will be described in detail below. It should be noted that FIGS. 9A, 10A, and 10B show directions D1 and D2 for the convenience of explanation of the second embodiment. D1 is a fore-and-aft direction of the connector, and D2 is a lateral direction that is orthogonal to the fore-and-aft direction D1.

The body 400*a* is an injection mold product made of an insulating resin as shown in FIGS. 9A to 11A. The body 400*a* has a generally rectangular block 410*a*, a pair of ring-shaped hinge protrusions 420*a*, and a pair of locking portions 430*a*. A rectangular accommodating recess 411*a* is formed in a center of the block 410*a*. The accommodating recess 411*a* passes through the block 410*a* in its thickness direction such that a rear side in the fore-and-aft direction D1 of the block 410*a* is open. A pressing portion 411*a*1 bridges rear ends of walls extending in the fore-and-aft direction D1 of the accommodating recess 411*a*. An upper face of the pressing portion 411*a*1 slopes downward to the rear side in the fore-and-aft direction D1. The pressing portion 411*a*1 is to be disposed on the rear side in the fore-and-aft direction D1 of a step 540*a* (to be described) of the conductive part 500*a*.

As shown in FIG. 10B, a generally rectangular attachment recess 412*a* is formed in the front end of the lower face of the block 410*a*. Toward the distal end in the fore-and-aft direction D1 of the accommodating recess 411*a* of the block 410*a*, there is formed a generally rectangular slit 413*a* extending from the bottom of the attachment recess 412*a* to the top of the block 410*a*. In front of the slit 413*a* of the block 410*a*, a generally rectangular lateral hole 414*a* extends orthogonally to and communicates with the slit 413*a*. On either side of the slit 413*a* of the block 410*a*, two cylindrical insertion holes 415*a* are arranged in alignment in the lateral direction D2. A pair of locking slits 416*a* is formed behind the opposite ends in the lateral direction D2 of the attachment recess 412*a* of the block 410*a*. The locking slits 416*a* each have a protrusions, not shown, on its front wall faces in the fore-and-aft direction D1. The walls in the lateral direction D2 of the accommodating recess 411*a* of the block 410*a* are formed with a pair of side recesses 417*a*, communicating with the accommodating recess 411*a*. In corners in the rear side in the fore-and-aft direction D1 of the block 410*a*, a pair of indention 418*a* is formed to avoid the interference of the block 410*a* with hinge protrusions 420*b* (to be described) of the body 400*b*.

The pair of hinge protrusions 420*a* is located inside the indentions 418*a* in the rear end of the block 410*a*. The hinge protrusions 420*a* have substantially the same configuration as the hinge protrusions 120*a* of the first embodiment. FIGS. 10A to 11A show hinge holes 421*a* and insertion holes 422*a*. Further descriptions will be omitted to avoid redundancies. The locking portions 430*a* (locking mechanism), which are generally rectangular protrusions, are continuous with the front sides in the fore-and-aft direction D1 of the hinge protrusions 420*a*. Locking claws 431*a* are provided on outer faces of the locking protrusions 430*a*.

The body 400*b* is an injection mold product made of an insulating resin as shown in FIGS. 9A to 10B and 11B. The body 400*b* has a generally rectangular block 410*b*, the pair of ring-shaped hinge protrusions 420*b*, and a pair of locking portions 430*b*. A rectangular accommodating recess 411*b* is formed in the center of the block 410*b*. The accommodating recess 411*b* passes through the block 410*b* in its thickness direction such that a rear side in the fore-and-aft direction D1 of the block 410*b* is open. A pressing portion 411*b*1 bridges rear ends of walls extending in the fore-and-aft direction D1 of the accommodating recess 411*b*. A lower face of the pressing portion 411*b*1 slopes upward to the rear side in the fore-and-aft direction D1. The pressing portion 411*b*1 is to be disposed on the rear side in the fore-and-aft direction D1 of a step 240*b* (to be described) of the conductive part 500*b*.

A generally rectangular locking slit 412*b* passes through the block 410*b* in the thickness direction, in a front portion in the fore-and-aft direction D1 of the accommodating recess 411*b* of the block 410*b*. A protrusion, not shown, is provided centrally on the rear wall in the fore-and-aft direction D1 of the locking slit 412*b*. The walls in the lateral direction D2 of the accommodating recess 411*b* of the block 410*b* are formed with a pair of side recesses 413*b*, communicating with the accommodating recess 411*b*. The side recesses 413*b* each have a step with its riser sloping downward to the rear side in the fore-and-aft direction D1.

The pair of hinge protrusions 420*b* are located at the rear corners in the fore-and-aft direction D1 of the block 410*b*. Inside the hinge protrusions 420*b* of the block 410*b*, a pair of hollows 414*b* is formed to avoid the interference of the block 410*b* with the hinge protrusions 420*a* of the body 400*a*.

Figure 11A:
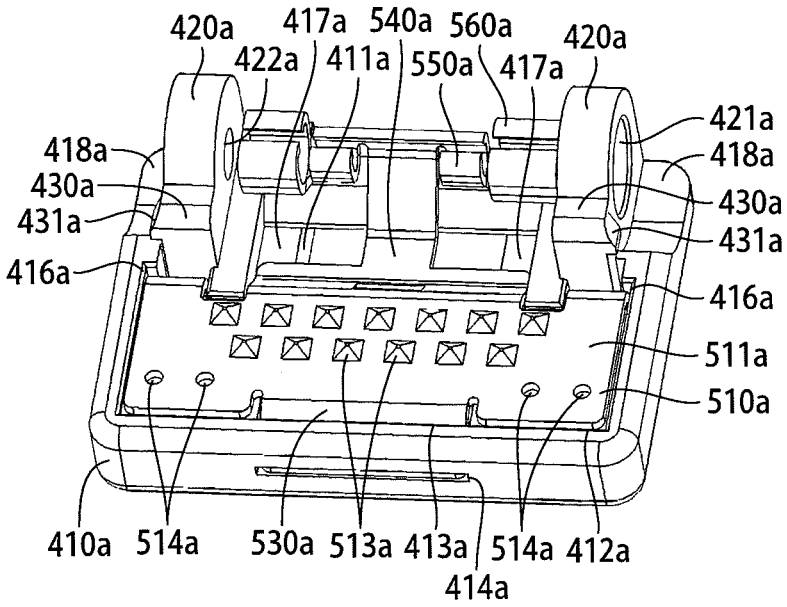
FIG. 11A is a front bottom left perspective view of a first body and a first conductive part of the connector.
Figure 11B:
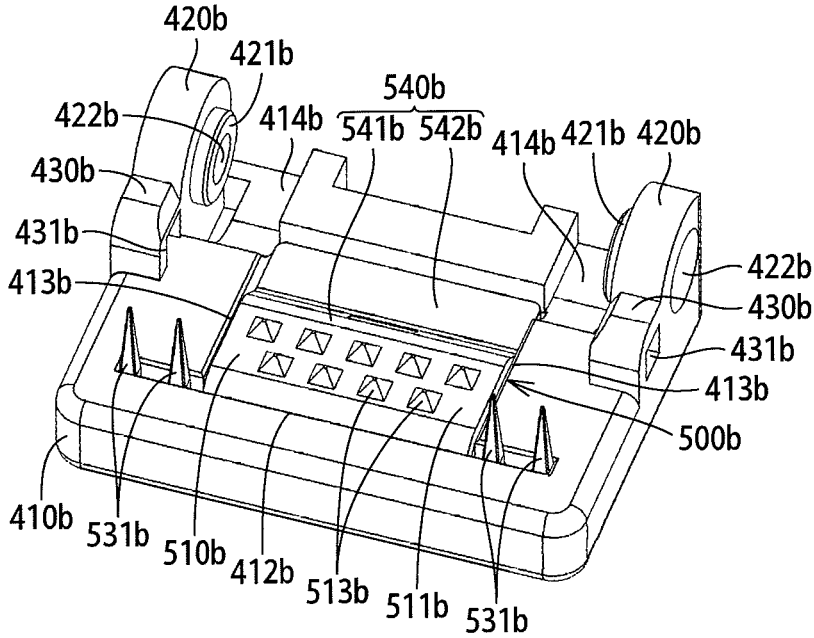
FIG. 11B is a front top right perspective view of a second body and a second conductive part of the connector.

The hinge protrusions 420*b* have substantially the same configuration as the hinge protrusions 120*b* of the first embodiment. FIGS. 10A, 10B, and 11B show hinge shafts 421*b* and insertion holes 422*b*. Further descriptions will be omitted to avoid redundancies. When the hinge shafts 421*b* fit into the hinge holes 421*a* of the hinge protrusions 420*a*, the bodies 400*a* and 400*b* will be hinged together openably and closably. FIG. 9A shows a closed state of the bodies 400*a* and 400*b* (that is, a closed state of the connector), and FIG. 9B shows an open state of the bodies 400*a* and 400*b* (that is, an open state of the connector). The locking portions 430*b* (locking mechanism), which are generally rectangular protrusions, are continuous with the front sides in the fore-and-aft direction D1 of the hinge protrusions 420*b*. The distance between inner faces of the locking protrusions 430*b* is slightly smaller than the distance between outer faces of the locking protrusions 430*a*. The locking protrusions 430*b* have locking holes 431*b* passing through the locking protrusions 430*b* in the lateral direction D2. In the closed state, the locking holes 431*b* may lockingly receive the locking claws 431*a* of the locking portions 430*a*.

As shown in FIGS. 10A to 11B, the conductive part 500*a* is configured of a metal plate having electrical conductivity. The conductive part 500*a* has a main plate 510*a*, a pair of side locking pieces 520*a*, a front locking piece 530*a*, the step 540*a* (a first step of an engaging mechanism), a pair of connecting portions 550*a*, and a pair of holding portions 560*a*. The main plate 510*a* is a generally rectangular plate, and it has a first face 511*a* (a first face of the first conductive part), and a second face 512*a* (a second face of the first conductive part) being the opposite face of the first face 511*a*. The first face 511*a* is to be brought into contact with the conductive fabric. A plurality of projections 513*a* of square pyramid shape are disposed in a zigzag manner in the middle of the first face 511*a*. As shown in FIG. 11A, the main plate 510*a* is accommodated in the attachment recess 412*a* of the body 400*a* so as to cover the front portion in the fore-and-aft direction D1 of the accommodating recess 411*a* and the insertion holes 415*a*. Two locking holes 514*a*, aligned in the lateral direction D2, are formed in each end in the lateral direction D2 of the main plate 510*a* (each end of the first face 511*a*). The locking holes 514*a* communicate with the associated insertion holes 415*a*. The second face 512*a* of the main plate 510*a* is exposed in the center through the accommodating recess 411*a*.

The main plate 510*a* is provided in its front center with the front locking piece 530*a* and in its rear center with the step 540*a*. The pair of side locking pieces 520*a* are provided at opposite ends of the rear end of the main plate 510*a*. The front locking piece 530*a* is a substantially L-shaped member that is bent substantially at a right angle to the main plate 510*a*. The front locking piece 530*a* is to be inserted into the slit 413*a* of the body 400*a*, and a front end of the front locking piece 530*a* is to be locked in the lateral hole 414*a*. The side locking pieces 520*a* are bent substantially at a right angle to the main plate 510*a* and extend upward. The side locking pieces 520*a* are provided with generally rectangular locking holes. The side locking pieces 520*a* are to be inserted into the locking slits 416*a* of the body 400*a*, such that the locking holes of the side locking pieces 520*a* lockingly receive the protrusions inside the locking slits 416*a* of the body 400*a*. As a result, the front locking piece 530*a* is locked in the lateral hole 414*a*, and the side locking pieces 520*a* are locked in the locking slits 416*a* of the body 400*a*, such that the conductive part 500*a* is fixed inside the body 400*a*.

The step 540*a* has substantially the same configuration as the step 240*a* of the first embodiment. FIGS. 9B to 11A show an inclined plate 541*a*, a projected piece 541*a*1 (a first projection), and an arm plate 542*a*. Further descriptions will be omitted to avoid redundancies. The inclined plate 541*a* is accommodated at its end portions in the lateral direction D2 in the side recesses 417*a* of the body 400*a* and exposed in its middle portion through the accommodating recess 411*a* of the body 400*a*. The arm plate 542*a* is also exposed through the accommodating recess 411*a*.

The connecting portions 550*a* have substantially the same configuration as the connecting portions 250*a* of the first embodiment. The holding portions 560*a* have substantially the same configuration as the holding portions 260*a* of the first embodiment. Accordingly, further descriptions will be omitted to avoid redundancies.

As shown in FIGS. 9B to 10B and 11B, the conductive part 500*b* is configured of a metal plate having electrical conductivity. The conductive part 500*b* has a main plate 510*b*, a front locking piece 520*b*, a pair of side plates 530*b*, and a step 540*b* (a second step of the engaging mechanism). The main plate 510*b* is a generally rectangular plate, and it has a first face 511*b* (a first face of the second conductive part), and a second face 512*b* (a second face of the second conductive part) being the opposite face of the first face 511*b*. The first face 511*b* is to be brought into contact with the conductive fabric. A plurality of projections 513*b* of square pyramid shape are disposed in a zigzag manner on the first face 511*b*. As shown in FIG. 11B, ends in the lateral direction D2 of the main plate 510*b* are accommodated in the side recesses 413*b* of the body 400*b* such that the main plate 510*b* covers the front portion in the fore-and-aft direction D1 of the accommodating recess 411*b*. The first face 511*b* of the main plate 510*b* and the first face 511*a* of the main plate 510*a* are opposed to each other so as to hold the conductive fabric therebetween. In addition, the second face 512*b* of the main plate 510*b* is exposed in the middle through the accommodating recess 411*b*.

The front locking piece 520*b* is provided centrally on a front end of the main plate 510*b*. The front locking piece 520*b* is bent substantially at a right angle to the main plate 510*b* and extends downward. The front locking piece 520*b* has a generally rectangular locking hole. The front locking piece 520*b* is to be inserted into the locking slit 412*b* of the body 400*b*, the locking hole of the front locking piece 520*b* is to lockingly receive the protrusion inside the locking slit 412*b* of the body 400*b*. The pair of side plates 530*b* are continuous with opposite ends of the front end of the main plate 510*b*. The side plates 530*b* are bent substantially at a right angle to the main plate 510*b* and extend in the lateral direction D2. A pair of press-in pieces are provided on outer ends of the side plates 530*b*. The distance between the distal ends of the press-in pieces is slightly larger than the width in the lateral direction D2 of the locking slit 412*b*. That is, the side plates 530*b* and the front locking piece 520*b* are to be inserted into the locking slit 412*b*, and the press-in pieces are to be locked against the inner walls in the lateral direction D2 of the locking slit 412*b*. As a result, the front locking piece 520*b* and the side plates 530*b* are locked in the locking slit 412*b*, such that the conductive part 500*b* is fixed inside the body 400*b*.

Two locking projections 531*b*, aligned in the lateral direction D2, extend to the conductive part 500*a* side (i.e. upward) from each of the side plates 530*b*. The locking projections 531*b* located outside in the lateral direction D2 of the first face 511*b* of the main plate 510*b*, and they are insertable into the locking holes 514*a* of the conductive part 500*a* and further into the insertion holes 415*a* of the body 400*a*.

The step 540*b* has substantially the same configuration as the step 240*b* of the first embodiment. FIGS. 10A, 10B, and 11B show an inclined plate 541*b*, a projected piece 541*b*1 (a second projection), and a horizontal plate 542*b*. Further descriptions will be omitted to avoid redundancies. The end portions in the lateral direction D2 of the inclined plate 541*b* and the horizontal plate 542*b* are accommodated in the side recesses 413*b* of the body 100*b*, while the middle portions thereof are exposed through the accommodating recess 411*b* of the body 400*b*.

The spring clip 600 (clamp of the biasing device) is a generally C-shaped metal plate having electrical conductivity as shown in FIGS. 10A and 10B. The spring clip 600 has a first arm 610, a second arm 620, and an intermediate portion 630. The intermediate portion 630 is a plate curved generally in an arc shape. The first arm 610 and the second arm 620 have substantially the same configuration as the first arm 310 and the second arm 320, except that the first arm 610 and the second arm 620 do not have the operation protrusions 312 and 322. FIGS. 10A and 10B show holes 611 and 621 (first and second holes of the engaging mechanism).

The following paragraphs describes in detail the steps of assembling the connector of the above configuration (except for steps of attaching the spring clip 600). The first step is to prepare the body 400*a* made by a known injection molding method and the conductive part 500*a* made by a known press molding method. The next step is to insert the front locking piece 530*a* of the conductive part 500*a* into the slit 413*a* of the body 400*a*, and to lock the front end of the front locking piece 530*a* in the lateral hole 414*a*. Simultaneously, the side locking pieces 520*a* of the conductive part 500*a* are inserted into the associated locking slits 416*a* of the body 400*a*. Then, the protrusions inside the locking slits 416*a* of the body 400*a* are locked into the locking holes of the side locking pieces 520*a*. Also, the main plate 510*a* of the conductive part 500*a* is accommodated in the attachment recess 412*a* of the body 400*a*, and the ends of the inclined plate 541*a* of the conductive part 500*a* are accommodated in the side recesses 417*a* of the body 400*a*. The connecting portions 550*a* and the holding portions 560*a* of the conductive part 500*a* are placed between the hinge protrusions 420*a* of the body 400*a*.

Also prepared are the body 400*b* made by a known injection molding method and the conductive part 500*b* made by a known press molding method. Thereafter, the front locking piece 520*b* and the side plates 530*b* of the conductive part 500*b* are pressed into the locking slit 412*b* of the body 400*b*. Then, the protrusion inside the locking slit 412*b* of the body 400*b* is locked into the locking hole of the front locking piece 520*b*, and the press-in pieces of the side plates 530*b* are locked against the inner walls of the locking slit 412*b*. At this time, the ends of the main plate 510*b* and the step 540*b* are accommodated in the side recesses 413*b* of the body 400*b*.

Thereafter, the hinge shafts 421*b* of the body 400*b* are fitted into the associated hinge holes 421*a* of the body 400*a*. Consequently, the bodies 400*a* and 400*b* are hinged openably and closably. Thereafter, the bodies 400*a* and 400*b* are brought into the open state, and as in the first embodiment, a core wire of the cable C is electrically connected to the connection portion 550*a* and the cable C is held in the holding portion 560*a*.

The following paragraphs describe how to connect the conductive fabric to the connector and how to attach the spring clip 600. First, the conductive fabric is inserted between the bodies 400*a* and 400*b* in the open state, and the bodies 400*a* and 400*b* are closed. Then, the conductive fabric is sandwiched between the main plate 510*a* of the conductive part 500*a* and the main plate 510*b* of the conductive part 500*b*. At this time, the locking projections 531*b* of the conductive part 500*b* penetrate the conductive fabric and pass through the locking holes 514*a* of the conductive part 500*a* and into the insertion holes 415*a* of the body 400*a*. Simultaneously, the locking claws 431*a* of the locking portions 430*a* are locked into the locking holes 431*b* of the locking portions 430*b*, and the bodies 400*a* and 400*b* are temporarily fixed in the closed state.

Thereafter, the first and second arms 610 and 620 of the spring clip 600 are inserted into the accommodating recesses 411*a* and 411*b* of the bodies 400*a* and 400*b*, respectively. Then, the first and second arms 610 and 620 are pressed by the pressing portions 411*a*1 and 411*b*1 in the accommodating recesses 411*a* and 411*b*, and they elastically deform in the directions away from each other. When the first and second arms 610 and 620 climb over the pressing portions 411*a*1 and 411*b*1 and the steps 540*a* and 540*b* of the conductive parts 500*a* and 500*b*, the distal ends of the first and second arms 610 and 620 elastically abut the second faces 512*a* and 512*b* of the main plates 510*a* and 510*b* of the conductive parts 500*a* and 500*b*. Simultaneously, the first and second arms 610 and 620 are engaged with the steps 540*a* and 540*b* of the conductive parts 500*a* and 500*b*, and the projected pieces 541*a*1 and 541*b*1 of the steps 540*a* and 540*b* are engaged in the holes 611 and 621 of the first and second arms 610 and 620. Consequently, the spring clip 600 is attached to the conductive parts 500*a* and 500*b* to elastically hold the conductive parts 500*a* and 500*b* holding the conductive fabric therebetween.

To detach the spring clip 600, the first and second arms 610 and 620 are elastically deformed open. The first arm 610 and the second arm 620 are thus disengaged from the steps 540*a* and 540*b*, and the projected pieces 541*a*1 and 541*b*1 of the steps 540*a* and 540*b* are also disengaged from the holes 611 and 621 of the first and second arms 610 and 620. Thereafter, the spring clip 600 is pulled out from the accommodating recesses 411*a* and 411*b* of the bodies 400*a* and 400*b*.

Thereafter, the bodies 400*a* and 400*b* are pulled open. Then, the locking projections 531*b* of the conductive part 500*b* come out of the locking holes 514*a* of the conductive part 500*a*, the insertion holes 415*a* of the body 400*a*, and the conductive fabric; while the locking claws 431*a* of the locking portions 430*a* get disengaged from the locking holes 431*b* of the locking portions 430*b*. It is now possible to pull out the conductive fabric from between the main plate 510*a* of the conductive part 500*a* and the main plate 510*b* of the conductive part 500*b*.

The connector of the above embodiment provides the same advantageous effects as the connector of the first embodiment. Further advantageously, the locking portions 430*a* and 430*b* are provided near the hinge portions 420*a* and 420*b*, reducing the possibility of inadvertent release of the above-mentioned temporary fixation by the locking portions 430*a* and 430*b*.

The present invention is not limited to connectors of the first and second embodiments but may be modified in design within the scope of claims. Design modification examples of the connector will be described below in detail.

The first and second conductive parts may be configured like the conductive parts 200*a* and 200*b*/500*a* and 500*b* of the first and second embodiments that are metal plates having electrical conductivity. The first and second conductive parts of the invention may be modified in design as long as they are made of materials having electrical conductivity, are opposed to each other, and can hold therebetween a flexible electric conductor such as a conductive fabric. For example, the first and second conductive parts may be conductive metals manufactured by a casting method, or they may be fabricated by evaporating metals having electrical conductivity onto outer faces of resin members.

The invention is not limited to the cases of the first and second embodiments where the locking holes 214*a*/514*a* are provided in the main plate 210*a*/510*a* of the conductive part 200*a*/500*a* and where the locking projections 231*b*/531*b* are provided on the side plates 230*b*/530*b* of the conductive part 200*b*/500*b*. The invention requires at least one locking hole, which may be provided anywhere in at least one of the first conductive part and the first body, and at least one locking projection of pointed shape, which may be provided in at least one of the second conductive part and the second body, at such a location as to be received in the locking hole. The locking hole may be a locking recess.

The locking projection may be provided with a barb. In this case, when the locking projection with a barb penetrates a flexible electric conductor such as a conductive fabric, the barb serves to prevent the locking projection from falling off of the electric conductor. Therefore, the locking projection is less likely to fall off of the electric conductor, further improving a tension strength of the connector with respect to the electric conductor. In addition, the barb may be locked into the locking hole or recess. In this case, with the barb locked in the locking hole or recess, the first and second conductive parts are maintained in a state of holding the electric conductor, further improving the tension strength of the connector with respect to the electric conductor.

The invention is not limited to the cases of the first and second embodiments where the projections 214*a* and 214*b*/514*a* and 514*b* of square pyramid shape are provided on the first faces 211*a* and 211*b*/511*a* and 511*b* of the conductive parts 200*a* and 200*b*/500*a* and 500*b*. For example, the projections may be omitted if sufficient electrical continuity can be obtained by just bringing the first and second conductive plates into surface contact with the electric conductor. The projections may be of square pyramid shape or any other convex shapes, such as triangular pyramid shapes and cut-and-raised teeth as used in graters.

The invention is not limited to the cases of the first and second embodiments where the conductive part 200*a*/500*a* has the connecting portions 250*a*/550*a*. The connector of the invention may include a connecting portion of any shape that may be provided in at least one of the first and second conductive parts and may be connectable to the cable. Further, The invention is not limited to the cases of the first and second embodiments where the conductive part 200*a*/500*a* has the holding portions 260*a*/560*a*. The connector of the invention may include a holding portion of any shape that may be provided in at least one of the first and second conductive parts and may hold a cable. The connecting portion may be omitted if the connector of the invention is not for connection with a cable. The holding portion may also be omitted if the connector of the invention is not for connection with a cable, or if the cable can be securely fixed to the connecting portion or any other member.

The invention is not limited to the cases of the first and second embodiments where the spring clip 300/600 (the clamp of the biasing device) is a generally C-shaped conductive plate. The biasing device of the invention may have any configuration as long as it is generally C-shaped and adapted to hold the first and second conductive parts holding the electric conductor therebetween. The spring clip 300/600 may or may not be electrically conductive and may or may not include a clamp of generally C made of resin. The biasing device may directly or indirectly hold the conductive parts 200*a* and 200*b*/500*a* and 500*b*. For example, the spring clip 300/600 may hold the bodies 100*a* and 100*b*/400*a* and 400*b* so that the spring clip 300/600 can indirectly holds the conductive parts 200*a* and 200*b*/500*a* and 500*b*.

The engaging mechanism of the invention is not limited to the ones according to the first and second embodiments, including the steps 240*a* and 240*b*/540*a* and 540*b* of the conductive parts 200*a* and 200*b*/500*a* and 500*b* for engagement with the first and second arms 310 and 320/610 and 620, the projected pieces 241*a*1 and 241*b*1/541*a*1 and 541*b*1 of the steps 240*a* and 240*b*/540*a* and 540*b*, and the holes 311 and 321/611 and 621 of the first and second arms 310 and 320/610 and 620 for engagement with the projected pieces 241*a*1 and 241*b*1/541*a*1 and 541*b*1. For example, the engaging mechanism may only include steps configured to engage with the first and second arms. Alternatively, the engaging mechanism may include first and second projections provided in the first and second conductive parts, respectively, and first and second holes provided in the first and second arms, respectively; or the engaging mechanism may include first and second holes provided in the first and second conductive parts, respectively, and first and second holes provided in the first and second arms, respectively. In either of these two cases, the first and second projections may engage in the first and second holes. In addition, the engaging mechanism may be recesses configured to engage the first and second arms. Further, the engaging mechanism to engage the biasing device may be provided in the first and second bodies.

The bodies of the invention is not limited to the cases of the first and second embodiments where the bodies 100*a* and 100*b*/400*a* and 400*b* are hinged together openably and closably. For example, the first body with the first conductive part fixed thereto may be separately provided from the second body with the second conductive part fixed thereto, in which case the first and second bodies may be combined when the urging device holds the first and second conductive parts. Further, the first and second bodies can be omitted. In this case, the present invention may be modified such that the first and second conductive parts are hinged together openably and closably, or alternatively, the first and second conductive parts may be provided separately and combined when sandwiched by the biasing device.

The invention is not limited to the cases of the first and second embodiments where the accommodating recesses 111*a* and 111*b*/411*a* and 411*b* are formed the bodies 100*a* and 100*b*/400*a* and 400*b*, respectively. If the biasing device indirectly holds the first and second conductive parts via the first and second bodies as described above, the accommodating recesses are unnecessary. In addition, as in the first and second embodiments, the spring clip 300/600 may be entirely accommodated in the accommodating recesses 111*a* and 111*b*/411*a* and 411*b*, but the accommodating recesses may have such a shape as to accommodate a portion of the spring clip or any other biasing device.

The invention is not limited to the cases of the first and second embodiments where the hinge holes 121*a*/421*a* and the insertion holes 122*a*/422*a* are formed in the hinge protrusions 120*a*/420*a* of the body 100*a*/400*a*. At least one hinge hole will suffice. The hinge holes may be omitted if the cable C is connected to the connecting portion at a different location. In addition, the invention is not limited to the cases of the first and second embodiments where the receiving holes 122*b*/422*b* pass in the lateral direction D2 through the hinge protrusions 120*b*/420*b* of the body 100*b*/400*b*. The receiving holes may be omitted if the cable C is connected to the connecting portion at a different location. In addition, the hinge protrusions 120*a*/420*a* may be provided with hinge shafts and the hinge protrusions 120*b*/420*b* may be provided with hinge holes. If the first and second bodies are not hinged together, the hinge protrusions, the hinge holes, and the hinge shafts may be omitted. In addition, the hinge protrusions, the hinge holes, and the hinge shafts may be provided in the first and second conductive parts, and the first and second conductive parts may be hinged together as described above.

The locking mechanism may include the locking portions 430*a* provided in front of the hinge protrusions 420*a*, the locking claws 431*a* provided on the outer faces of the locking protrusions 430*a*, the locking portions 430*b* provided in front of the hinge protrusions 420*b*, and the locking holes 431*b* provided in the locking protrusions 430*b* as in the second embodiment. However, the locking mechanism may be any mechanism for locking the first body with the second body in the state where the first and second conductive parts hold the electric conductor therebetween. For example, the locking mechanism may include locking claws provided on one of the first and second bodies, and locking holes or recesses provided in the other of the first and second bodies to lock the locking claws in the state where the first and second conductive parts hold the electric conductor therebetween.

The invention is not to be considered as limited by the first and second embodiments, for which the materials, shapes, dimensions, arrangements, etc. of the respective elements are described by way of example only, and they may be modified in design in any manner as long as they provide similar functions. Also, the electric conductor may be a flexible conductive fabric as in the first and second embodiments above, but the connector of the invention is also applicable to connection with any other electric conductor including conductive sheets and locating tapes.

REFERENCE SIGNS LIST

- 100a Body (first body)
  - 110a Block
    - 111a Accommodating recess (first accommodating recess)
  - 120a Hinge protrusion
    - 121a Hinge hole
    - 122a Insertion hole
- 100b Body (second body)
  - 110b Block
    - 111b Accommodating recess (first accommodating recess)
  - 120b Hinge protrusion
    - 121b Hinge shaft
    - 122b Insertion hole
- 200a Conductive part (first conductive part)
  - 210a Main plate
    - 211a First face (first face of first conductive part)
    - 212a Second face (second face of first conductive part)
    - 213a Projection
    - 214a Locking hole
  - 220a Side locking piece
  - 230a Front plate
  - 240a Step (first step of engaging mechanism)
    - 241a1 Projected piece (first projection of engaging mechanism)
  - 250a Connecting portion
  - 260a Holding portion
- 200b Conductive part (second conductive part)
  - 210b Main plate
    - 211b First face (first face of second conductive part)
    - 212b Second face (second face of second conductive part)
    - 213b Projection
  - 220b Front plate
  - 230b Side plate
    - 231b Locking projection
  - 240b Step (second step of engaging mechanism)
    - 241b1 Projected piece (second projection of engaging mechanism)
  - 250b Side locking piece
- 300 Spring clip (clamp of biasing device)
  - 310 First arm
    - 311 Hole (first hole of engaging mechanism)
  - 320 Second arm
    - 321 Hole (second hole of engaging mechanism)
- 400a Body (first body)
  - 410a Block
    - 411a Accommodating recess (first accommodating recess)
  - 420a Hinge protrusion
    - 421a Hinge hole
    - 422a Insertion hole
  - 430a Locking portion (locking mechanism)
    - 431a Locking claw
- 400b Body (second body)
  - 410b Block
    - 411b Accommodating recess (first accommodating recess)
  - 420b Hinge protrusion
    - 421b Hinge shaft
    - 422b Insertion hole
  - 430b Locking portion (locking mechanism)
    - 431b Locking hole
- 500a Conductive part (first conductive part)
  - 510a Main plate
    - 511a First face (first face of first conductive part)
    - 512a Second face (second face of first conductive part)
    - 513a Projection
    - 514a Locking hole
  - 520a Side locking piece
  - 530a Front locking piece
  - 540a Step (first step of engaging mechanism)
    - 541a1 Projected piece (first projection of engaging mechanism)
  - 550a Connecting portion
  - 560a Holding portion -continued

| | | | |
|---|---|---|---|
| 500b | Conductive part (second conductive part) | | |
| | 510b | Main plate | |
| | | 511b | First face (first face of second conductive part) |
| | | 512b | Second face (second face of second conductive part) |
| | | 513b | Projection |
| | 520b | Side locking piece | |
| | 530b | Side plate | |
| | | 531b | Locking projection |
| | 540b | Step (second step of engaging mechanism) | |
| | | 541b1 | Projected piece (second projection of engaging mechanism) |
| 600 | Spring clip (clamp of biasing device) | | |
| | 610 | First arm | |
| | | 611 | Hole (first hole of engaging mechanism) |
| | 620 | Second arm | |
| | | 621 | Hole (second hole of engaging mechanism) |

The invention claimed is:

1. A connector comprising:

first and second conductive parts that are opposed to each other so as to hold a flexible electric conductor therebetween;

first and second bodies fixed to the first and second conductive parts, respectively, the first and second bodies being provided with first and second accommodating recesses, respectively; and a biasing device including a clamp of generally C shape, the clamp accommodated in the first and second accommodating recesses sandwiching the first and second conductive parts when the first and second conductive parts hold the electric conductor, wherein at least one of the first body and the first conductive part has a locking hole or locking recess, and at least one of the second body and the second conductive part has a locking projection of pointed shape, the locking projection being configured to pass through the electric conductor and be received in the locking hole or locking recess when the first and second conductive parts hold the electric conductor.

2. The connector according to claim 1, wherein at least one of the first and second conductive parts further comprises a connecting portion that is connectable to a cable.

3. The connector according to claim 2, wherein the first body includes a hinge shaft and the second body includes a hinge hole, or alternatively the first body includes a hinge hole and the second body includes a hinge shaft, the hinge shaft is of a tubular shape such as to fit in the hinge hole, and the hinge shaft and the hinge hole are configured to allow the cable to pass therethrough so as to connect the cable with the connecting portion.

4. The connector according to claim 2, wherein at least one of the first and second conductive parts further includes a holding portion to hold the cable.

5. The connector according to claim 1, wherein the locking projection is provided with a barb.

6. The connector according to claim 1, further comprising:

a locking mechanism to lock the first body with the second body in the state where the first and second conductive parts hold the electric conductor therebetween.

7. The connector according to claim 6, wherein the locking mechanism include:

a locking claw provided on one of the first and second bodies, and a locking hole or locking recess formed in the other of the first and second bodies and configured to lock the locking claw in the state where the first and second conductive parts hold the electric conductor therebetween.

8. A connector comprising:

first and second conductive parts that are opposed to each other so as to hold a flexible electric conductor therebetween, the first and second conductive parts each including a first face, being abuttable on the electric conductor, and a second face, being an opposite face of the first face, the first conductive part further including a locking hole or locking recess, the second conductive part further including a locking projection of pointed shape, the locking projection being configured to pass through the electric conductor and be received in the locking hole or locking recess when the first and second conductive parts hold the electric conductor;

a biasing device including a clamp of generally C shape to hold the first and second conductive parts holding the electric conductor, the clamp including first and second arms being elastically abuttable on the second faces of the first and second conductive parts, respectively; and an engaging mechanism, the engaging mechanism being configured to engage the first and second arms with the first and second conductive parts, respectively, in a state where the first and second arms elastically abut the second faces of the first and second conductive parts.

9. The connector according to claim 8, wherein the engaging mechanism includes first and second steps, the first and second steps being provided in the first and second conductive parts, respectively, and configured to engage with the first and second arms, respectively.

10. The connector according to claim 8, wherein the engaging mechanism includes first and second projections provided in the first and second conductive parts, respectively, and first and second holes provided in the first and second arms, respectively, or alternatively, the engaging mechanism includes first and second holes provided in the first and second conductive parts, respectively, and first and second projections provided in the first and second arms, respectively, wherein the first and second projections are configured to engage with the first and second holes.

11. The connector according to claim 8, wherein the first faces of the first and second conductive parts are provided with projections.

12. The connector according to claim 11, wherein the projections are of square pyramid shape.

13. The connector according to claim 8, wherein the locking projection comprises a plurality of locking projections arranged outside the first face of the second conductive part, and the locking hole or locking recess comprises a plurality of locking holes or locking recess arranged in opposite outer ends of the first face of the first conductive part.

14. A connector comprising:

first and second conductive parts that are opposed to each other so as to hold a flexible electric conductor therebetween, the first and second conductive parts each including a first face, being abuttable on the electric conductor, and a second face, being an opposite face of the first face;

first and second bodies fixed to the first and second conductive parts, respectively, at least one of the first body and the first conductive part including a locking hole or locking recess, at least one of the second body and the second conductive part including a locking projection of pointed shape, the locking projection being configured to pass through the electric conductor and be received in the locking hole or locking recess when the first and second conductive parts hold the electric conductor;

a biasing device including a clamp of generally C shape to hold the first and second conductive parts holding the electric conductor, the clamp including first and second arms being elastically abuttable on the second faces of the first and second conductive parts, respectively, and an engaging mechanism, the engaging mechanism being configured to engage the first and second arms with the first and second conductive parts, respectively, in a state where the first and second arms elastically abut the second faces of the first and second conductive parts.

15. The connector according to claim 14, wherein the engaging mechanism includes first and second steps, the first and second steps being provided in the first and second conductive parts, respectively, and configured to engage with the first and second arms, respectively.

16. The connector according to claim 14, wherein the engaging mechanism includes first and second projections provided in the first and second conductive parts, respectively, and first and second holes provided in the first and second arms, respectively, or alternatively, the engaging mechanism includes first and second holes provided in the first and second conductive parts, respectively, and first and second projections provided in the first and second arms, respectively, wherein the first and second projections are configured to engage with the first and second holes.

17. The connector according to claim 14, wherein the first faces of the first and second conductive parts are provided with projections.

18. The connector according to claim 17, wherein the projections are of square pyramid shape.

19. The connector according to claim 14, wherein the locking projection comprises a plurality of locking projections arranged outside the first face of the second conductive part, and the locking hole or locking recess comprises a plurality of locking holes or locking recess arranged in opposite outer ends of the first face of the first conductive part.

* * * * *